US008723732B2

(12) United States Patent
Lee et al.

(10) Patent No.: US 8,723,732 B2
(45) **Date of Patent: *May 13, 2014**

(54) DIELECTRIC RESONATOR ANTENNA EMBEDDED IN MULTILAYER SUBSTRATE FOR ENHANCING BANDWIDTH

(75) Inventors: Jung Aun Lee, Gyunggi-do (KR); Chul Gyun Park, Gyunggi-do (KR); Moonil Kim, Gyunggi-do (KR); Kook Joo Lee, Seoul (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 431 days.

This patent is subject to a terminal disclaimer.

(21) Appl. No.: 12/833,688

(22) Filed: Jul. 9, 2010

(65) Prior Publication Data

US 2011/0248890 A1 Oct. 13, 2011

(30) Foreign Application Priority Data

Apr. 13, 2010 (KR) ..... 10-2010-0033998

(51) Int. Cl.
*H01Q 1/38* (2006.01)

(52) U.S. Cl.
USPC ..... 343/700 MS; 343/702; 343/767

(58) Field of Classification Search
USPC ..... 343/700 MS, 702, 767, 911 R; 333/204, 333/202, 206, 219, 222, 219.1, 235; 331/99, 96, 56; 505/210; 156/345.41, 156/700 MS, 702, 767, 774
See application file for complete search history.

(56) References Cited

U.S. PATENT DOCUMENTS

| | | | | |
|---|---|---|---|---|
| 4,675,632 | A * | 6/1987 | Kawano | 333/222 |
| 5,444,452 | A * | 8/1995 | Itoh et al. | 343/700 MS |
| 5,450,090 | A * | 9/1995 | Gels et al. | 343/700 MS |
| 5,812,038 | A * | 9/1998 | Gu et al. | 333/219 |
| 6,064,350 | A * | 5/2000 | Uchimura et al. | 343/786 |
| 7,701,310 | B2 * | 4/2010 | Fujita | 333/26 |
| 7,924,227 | B2 * | 4/2011 | Yamada | 343/700 MS |
| 2007/0080864 | A1 * | 4/2007 | Channabasappa | 343/700 MS |
| 2011/0057741 | A1 * | 3/2011 | Dayan et al. | 333/26 |
| 2011/0057853 | A1 * | 3/2011 | Kim et al. | 343/843 |

FOREIGN PATENT DOCUMENTS

| | | |
|---|---|---|
| JP | 11-041010 | 2/1999 |
| JP | 2004-096206 | 3/2004 |
| JP | 2007-074422 | 3/2006 |

OTHER PUBLICATIONS

Office Action from counterpart Korean Patent Application No. 10-2010-0033998, Aug. 2011, 8 pages.

* cited by examiner

*Primary Examiner* — Douglas W Owens
*Assistant Examiner* — Jae Kim
(74) *Attorney, Agent, or Firm* — Bracewell & Giuliani LLP; Brad Y. Chin

(57) ABSTRACT

A dielectric resonator antenna embedded in a multilayer substrate is described. The dielectric resonator antenna includes a multilayer substrate, a first conductive plate, a second conductive plate, a plurality of first metal via holes, a feeding part configured to feed a dielectric resonator, and a conductive pattern part inserted into the dielectric resonator so that a vertical metal interface is formed in the dielectric resonator.

18 Claims, 22 Drawing Sheets

DIELECTRIC RESONATOR ANTENNA EMBEDDED IN MULTILAYER SUBSTRATE FOR ENHANCING BANDWIDTH

CROSS REFERENCE TO RELATED APPLICATION

This application claims the benefit of Korean Patent Application No. 10-2010-0033998, filed on Apr. 13, 2010, entitled "Dielectric Resonant Antenna Embedded in Multilayer Substrate for Enhancing Bandwidth", which is hereby incorporated by reference in its entirety into this application.

BACKGROUND OF THE INVENTION

1. Technical Field

The present invention relates generally to a dielectric resonator antenna embedded in a multilayer substrate for enhancing bandwidth.

2. Description of the Related Art

Mainly, products for a conventional transmission/reception system have been constructed by assembling individual parts into each system. However, research into System On Package (SOP) products in which a millimeter-wave band transmission/reception system is implemented as a single package has recently been conducted, and some products have been commercialized.

Technology related to SOP products has been developed along with technology related to a multilayer substrate manufacturing process which stacks dielectric substrates such as Low Temperature Co-fired Ceramic (LTCC) and Liquid Crystal Polymer (LCP) substrates.

Such a multilayer substrate package is manufactured using a single manufacturing process by embedding passive elements in a package as well as by integrating Integrated Circuits (ICs) which are active elements. Accordingly, there are effects in which an inductance component can be reduced thanks to reduced usage of conducting wires and in which loss attributable to coupling between elements can also be reduced, and there is an advantage in that the costs of manufacturing products can be retrenched.

However, in the case of an LTCC manufacturing process, a substrate may be contracted by about 15% in the x and y directions, which are planar directions of the substrate, during plastic working. Accordingly, fabrication errors occur, and thus a problem may arise from the standpoint of the reliability of products.

In a multilayer structure environment such as in LTCC and LCP manufacturing processes, a patch antenna having planar characteristics is mainly used, but has a disadvantage of a narrow bandwidth of about 5%.

In order to overcome such a disadvantage, methods of widening the bandwidth in such a way as to cause multiple resonances by adding a parasitic patch to the same plane as that of a patch antenna functioning as a main radiator or in such a way as to induce multiple resonances by stacking two or more patch antennas, have been used.

It is known that bandwidth of about 10% can be obtained using such a conventional multi-resonance technique.

However, when the conventional multi-resonance technique is used, differences may occur between the radiation patterns of an antenna at individual resonant frequencies, and variations in the characteristics of the antennas depending on fabrication errors in the multi-resonance antenna may be greater than in a single-resonance antenna.

Therefore, in order to increase the efficiency of such an antenna and ensure a wider bandwidth, a conventional Dielectric Resonator Antenna (DRA) is occasionally used.

It is known that such a conventional dielectric resonator antenna has more excellent bandwidth and efficiency characteristics than the above-described conventional patch antenna using a multi-resonance technique.

The conventional dielectric resonator antenna is frequently used to overcome the disadvantages of the conventional patch antenna, but it requires a separate dielectric resonator disposed outside a substrate, and thus there is the inconvenience of manufacturing processes compared to a stacked patch antenna implemented using a single manufacturing process.

Further, a conventional dielectric resonator antenna can ensure a wider bandwidth because multiple resonances occur as the size of a dielectric resonator (for example, the length of the dielectric resonator in a direction which does not influence resonant frequency) increases. In contrast, such a dielectric resonator antenna is disadvantageous in that the to radiation patterns thereof are deformed within the bandwidth.

SUMMARY OF THE INVENTION

Accordingly, the present invention has been made keeping in mind the above problems occurring in the prior art, and the present invention is intended to provide a dielectric resonator antenna embedded in a multilayer substrate for enhancing bandwidth, in which a multilayer substrate manufacturing process is implemented as a single manufacturing process, thus enabling a dielectric resonator antenna to be easily manufactured and minimizing variations in antenna characteristics depending on fabrication errors.

Further, the present invention is intended to provide a dielectric resonator antenna embedded in a multilayer substrate for enhancing bandwidth, which can minimize the deformation of radiation patterns attributable to multiple resonances while ensuring a wider bandwidth by means of multiple resonances.

In accordance with an aspect of the present invention, there is provided a dielectric resonator antenna embedded in a multilayer substrate for enhancing bandwidth, comprising a multilayer substrate provided with a plurality of insulating layers stacked one on top of another, a first conductive plate formed on a top of an uppermost insulating layer of the multilayer substrate and provided with an opening, a second conductive plate formed on a bottom of a lowermost insulating layer of at least two insulating layers which are formed on a bottom of the first conductive plate, the second conductive plate being disposed at a location corresponding to that of the opening, a plurality of first metal via holes configured to electrically connect layers between the uppermost insulating layer and the lowermost insulating layer, and vertically formed through the multilayer substrate so that the first metal via holes surround the opening of the first conductive plate at predetermined intervals and form vertical metal interfaces, a feeding part configured to include a feed line for applying a high-frequency signal to a dielectric resonator which is embedded in the multilayer substrate in a shape of a cavity by the first conductive plate, the second conductive plate, and the metal interfaces formed by the first metal via holes, and a conductive pattern part inserted into the dielectric resonator so that a vertical metal interface intersecting the feed line is formed in the dielectric resonator.

The dielectric resonator may have a shape of a hexahedron.

The conductive pattern part may comprise a plurality of second metal via holes vertically formed through the multilayer substrate within the dielectric resonator, and one or more third conductive plates formed to be coupled to the plurality of second metal via holes between the insulating layers through which the second metal via holes are formed.

The second metal via holes may be formed below at least one insulating layer, which is formed downwards on a bottom of the feed line, on a basis of the feed line.

The feeding part may be a stripline feeding part. The stripline feeding part may comprise a feed line formed as a linear conductive plate extending from one side surface of the dielectric resonator so that the feed line is inserted into the dielectric resonator to be level with the opening of the dielectric resonator, a first ground plate disposed to correspond to the feed line and formed on a top of at least one insulating layer which is formed upwards on a top of the feed line, and a second ground plate disposed to correspond to the feed line and formed on a bottom of at least one insulating layer which is formed downwards on a bottom of the feed line.

The first ground plate may be formed to be integrated with the first conductive plate.

The feed line may be formed between a bottom of the uppermost insulating layer and a top of the lowermost insulating layer.

The feed line may have an end portion formed in any one of line, step, taper and round shapes.

The feeding part may be a microstrip line feeding part. The microstrip line feeding part may comprise a feed line formed as a linear conductive plate extending from one side surface of the dielectric resonator so that the feed line is inserted into the dielectric resonator to be level with the opening of the dielectric resonator, and a ground plate disposed to correspond to the feed line and formed on a bottom of at least one insulating layer which is formed on a bottom of the feed line.

The feed line may be formed on a top of the uppermost insulating layer. The feed line may have an end portion formed in any one of line, step, taper and round shapes.

The feeding part may be a Coplanar Waveguide (CPW) line feeding part. The CPW line feeding part may comprise a feed line formed as a linear conductive plate extending from one side surface of the dielectric resonator so that the feed line is inserted into the dielectric resonator to be level with the opening of the dielectric resonator, a first ground plate formed on a same surface as the feed line and spaced apart from one side surface of the feed line, and a second ground plate formed on a same surface as the feed line and spaced apart from another side surface of the feed line.

The first ground plate and the second ground plate may be formed to be integrated with the first conductive plate.

The feed line may be formed on a top of the uppermost insulating layer.

The feed line may have an end portion formed in any one of line, step, taper and round shapes.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
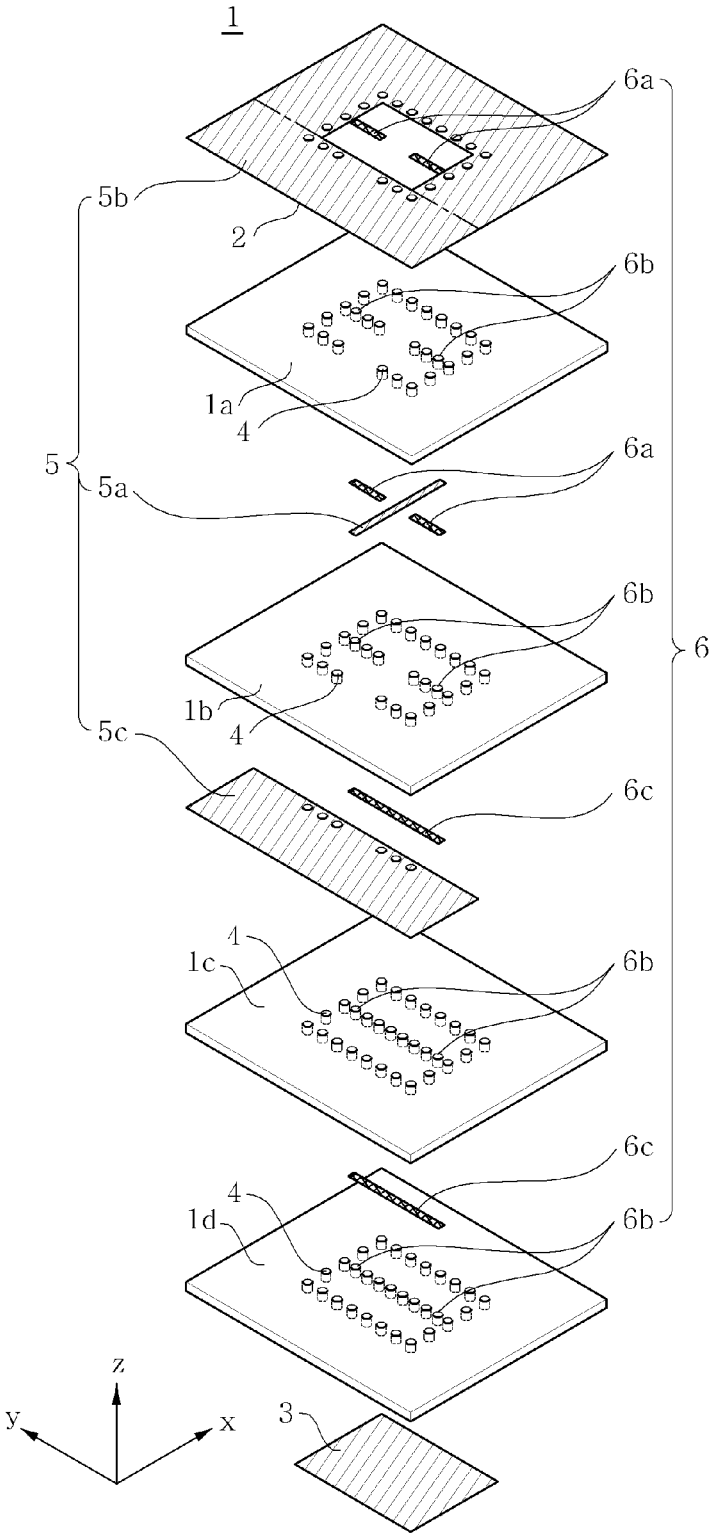
FIGS. 1 and 2 are exploded perspective views of a dielectric resonator antenna embedded in a multilayer substrate for enhancing bandwidth according to embodiments of to the present invention.

Hereinafter, embodiments of the present invention will be described in detail with to reference to the attached drawings.

For convenience of description, a multilayer substrate 1 according to the present invention is implemented as a substrate in which four insulating layers are stacked one on top of one another, but the multilayer substrate of the present invention is not limited to this structure.

Further, it should be noted that conductive layers other than conductive layers required for a feeding part are considered to be omitted and are not shown in the drawings of the present invention.

Figure 2:
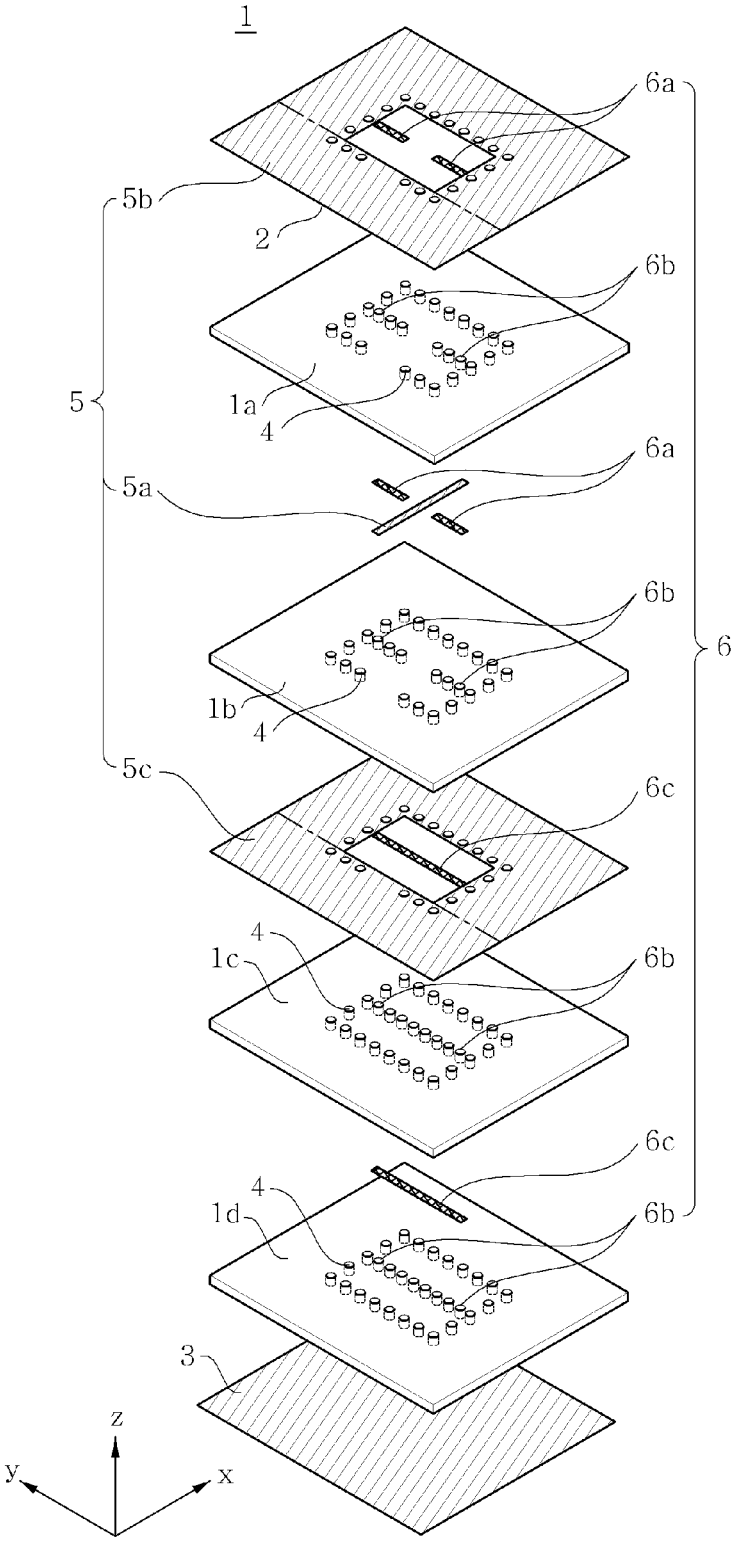
Figure 3:
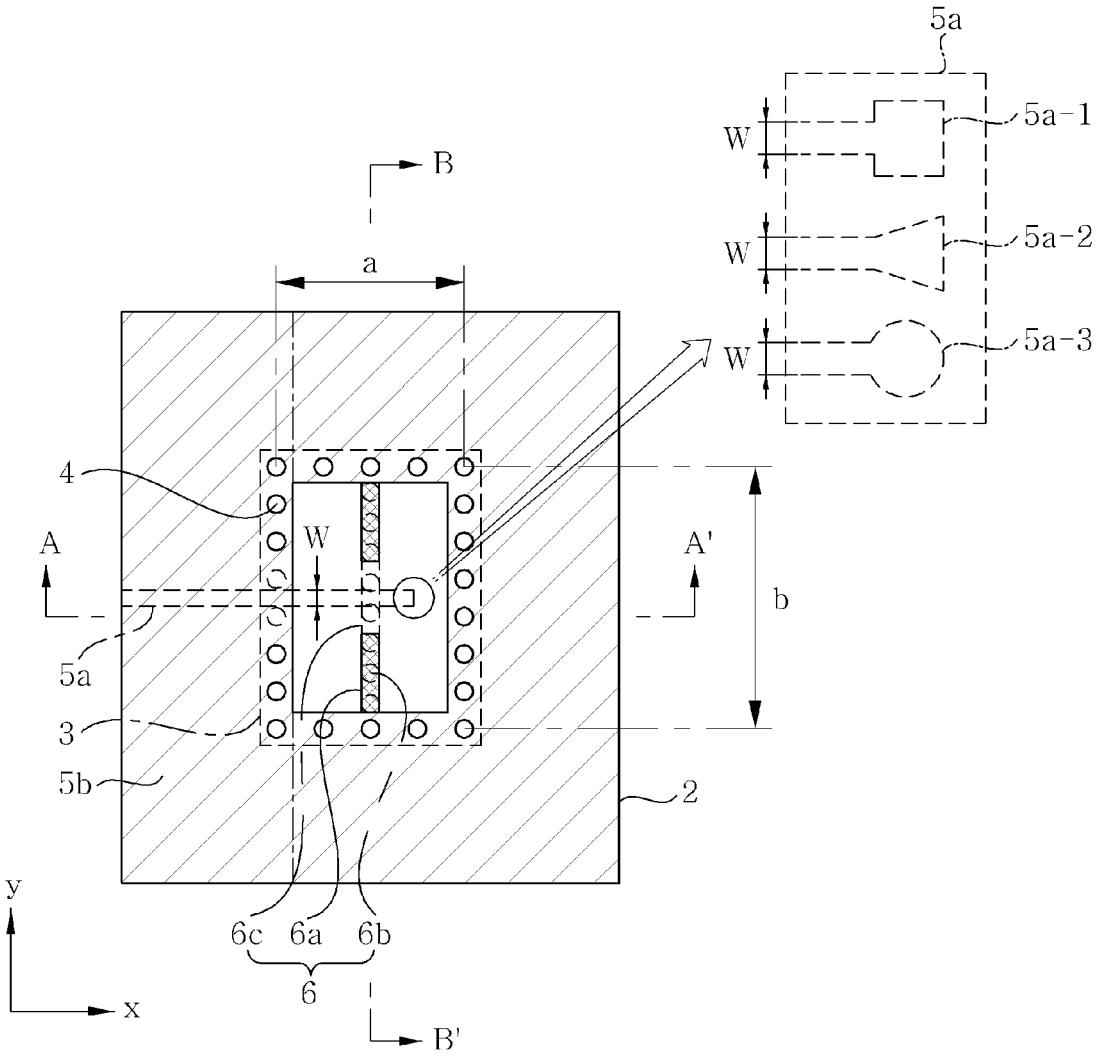
FIG. 3 is a top view of the dielectric resonator antenna of FIG. 1.
Figure 4:
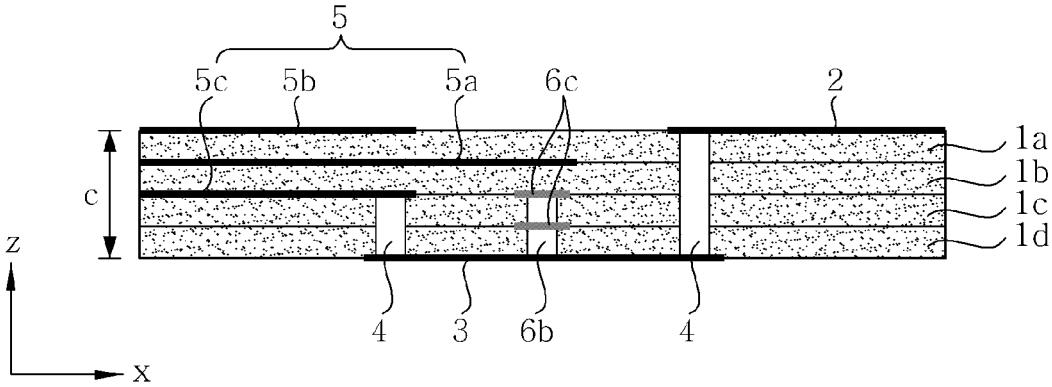
FIG. 4 is a sectional view of the dielectric resonator antenna of FIG. 1 taken along line A-A' of FIG. 3.
Figure 5:
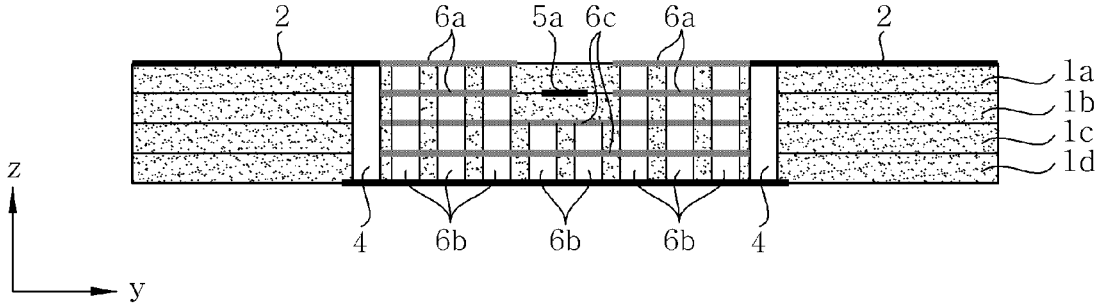
FIG. 5 is a sectional view of the dielectric resonator antenna of FIG. 1 taken along line B-B' of FIG. 3.

FIGS. 1 and 2 are exploded perspective views of a dielectric resonator antenna embedded in a multilayer substrate for enhancing bandwidth according to embodiments of the present invention, FIG. 3 is a top view of the dielectric resonator antenna of FIG. 1, FIG. 4 is a sectional view of the dielectric resonator antenna of FIG. 1 taken along line A-A' of FIG. 3, and FIG. 5 is a sectional view of the dielectric resonator antenna of FIG. 1 taken along line B-B' of FIG. 3.

Referring to FIGS. 1 and 2, the dielectric resonator antenna embedded in a multilayer substrate 1 for enhancing bandwidth according to an embodiment of the present invention includes the multilayer substrate 1, a first conductive plate 2 disposed on the top of the uppermost insulating layer 1*a* of the multilayer substrate 1 and provided with an opening, a second conductive plate 3 disposed on the bottom of the lowermost insulating layer 1*d* of the multilayer substrate 1, a plurality of first metal via holes 4 formed through the area between the uppermost insulating layer 1*a* and the lowermost insulating layer 1*d*, a feeding part 5 configured to include a feed line 5*a* and one or more ground plates 5*b* and 5*c*, and a conductive pattern part 6 inserted into a dielectric resonator.

The multilayer substrate 1 is formed such that the insulating layers 1*a* to 1*d* are stacked one on top of another, thus enabling a dielectric resonator to be embedded in the multilayer substrate 1.

In a conventional dielectric resonator antenna, an interface acts as a magnetic wall to due to a difference in permittivity between air and a dielectric antenna, formed on a single substrate in the shape of a rectangular parallelepiped or a cylinder, thus forming a resonance mode at a specific frequency.

In contrast, when the dielectric resonator is embedded in the multilayer substrate 1 as in the case of the present invention, the resonance mode is maintained using the vertical metal interfaces of the multilayer substrate 1, a metal interface formed by the conductive plate disposed on the bottom of the lowermost insulating layer of the multilayer substrate 1, and the magnetic wall of the opening formed on the top of the uppermost insulating layer.

In an ideal case, the vertical metal interfaces of the substrate are required in a multilayer structure, but a plurality of metal via holes arranged at regular intervals may be used to replace the metal interfaces due to difficulty of manufacture.

Therefore, as shown in FIGS. 1 and 2, in order for the dielectric resonator to be embedded in the multilayer substrate 1, the first conductive plate 2 having an opening is formed on the top of the uppermost insulating layer 1*a*.

Further, the second conductive plate 3 disposed at the location corresponding to that of the opening is formed on the bottom of the lowermost insulating layer 1*d*, among at least two insulating layers formed downwards on the bottom of the first conductive plate 2.

Here, the second conductive plate 3 is shown to have a size which is equal to the size defined by the first metal via holes 4, as shown in FIG. 1.

However, this is only the minimum size required to implement the dielectric resonator according to the embodiment of the present invention, and it is also possible to use a conductive plate having a size equal to that of the multilayer substrate 1, as shown in FIG. 2.

Further, individual layers between the uppermost insulating layer 1*a* and the lowermost insulating layer 1*d* are electrically connected. The first metal via holes 4 are vertically formed through the multilayer substrate 1 so that they surround the opening of the first conductive plate 2 at predetermined intervals and form vertical metal interfaces.

By the above procedure, the dielectric resonator with only one open surface (for example, the surface of the first conductive plate 2 on which the opening is formed) is embedded in the multilayer substrate 1 in the shape of a cavity by the first conductive plate 2, the second conductive plate 3 and the metal interfaces formed by the first metal via holes 4.

The feeding part 5 is formed in a portion of the dielectric resonator, embedded in the multilayer substrate 1 in the shape of the cavity, to feed the dielectric resonator.

Such a feeding part 5 is implemented to feed the dielectric resonator using a transmission line (hereinafter referred to as a 'feed line') such as a stripline, a microstrip line or a Coplanar Waveguide (CWP) line which can be easily formed in the multilayer substrate 1.

The feeding part 5 is composed of one feed line 5*a* and one or more ground plates 5*b* and 5*c*.

The feeding part 5 of the dielectric resonator antenna shown in FIGS. 1 and 2 is implemented using a stripline.

In more detail, the stripline feeding part 5 is composed of the feed line 5*a*, the first ground plate 5*b* and the second ground plate 5*c*.

The feed line 5*a* is formed as a linear conductive plate extending from one side surface of the dielectric resonator so that the feed line 5*a* is inserted into the dielectric resonator to be level with the opening of the dielectric resonator.

In this case, an end portion of the feed line 5*a* inserted into the dielectric resonator is basically formed in a line shape, but may also be formed in a step shape 5*a*-1, a taper shape 5*a*-2 or a round shape 5*a*-3, as shown in FIG. 3.

The first ground plate 5*b* is disposed to correspond to the feed line 5*a* and is formed on the top of at least one insulating layer 1*a* which is formed upwards on the top of the feed line 5*a*.

The second ground plate 5*c* is disposed to correspond to the feed line 5*a* and is formed on the bottom of at least one insulating layer 1*b* which is formed downwards on the bottom of the feed line 5*a*.

The above-described first and second ground plates 5*b* and 5*c* must be formed at locations corresponding to that of the feed line 5*a*, and the sizes and shapes thereof are not limited.

In FIGS. 1 and 2, the first ground plate 5*b* requires at least a partial region 5*b*, corresponding to the location of the feed line 5*a*, of the region partitioned by a dotted line, but may be replaced with the first conductive plate 2 including the partial region 5*b*.

That is, the first ground plate 5*b* may be formed to be integrated with the first conductive plate 2.

Further, in FIG. 1, the second ground plate 5*c* is shown to be a conductive plate formed as a partial region corresponding to the location of the feed line 5*a*, but may be formed as a conductive plate having the same shape and size as those of the first conductive plate 2, as shown in FIG. 2.

The dielectric resonator antenna embedded in the multilayer substrate 1 according to embodiments of the present invention, as shown in FIGS. 1 and 2, is configured such that the feed line 5*a* is formed on a top of the second insulating layer 1*b* and such that the first and second ground plates 5*b* and 5*c* are respectively formed on the top and bottom of the insulating layer 1*a* and the insulating layer 1*b* which are respectively formed upwards and downwards on the feed line 5*a*.

Therefore, as described above, a part of the first conductive plate 2 functions as the first ground plate 5*b*.

When the dielectric resonator antennas of FIGS. 1 and 2 are compared to each other, they are different from each other only in the sizes of the second conductive plates 3 and the first and second ground plates 5*b* and 5*c*, and perform the same functions and roles as the dielectric antenna embedded in the multilayer substrate 1 for enhancing bandwidth according to the embodiments of the present invention.

Therefore, a description will be made on the basis of the dielectric resonator antenna of FIG. 1, and a detailed drawing and description of the dielectric resonator antenna of FIG. 2 will be omitted.

The above-described dielectric resonator antenna embedded in the multilayer substrate 1 for enhancing bandwidth functions as an antenna radiator to which a high-frequency signal is applied through the feed line 5*a* of the feeding part 5 and which radiates a high-frequency signal resonating at a specific frequency through the opening depending on the shape and size of the dielectric resonator.

Meanwhile, the feed line 5*a* of the feeding part 5 can be disposed at any location between the top of the uppermost insulating layer 1*a* and the top of the lowermost insulating layer 1*d* of the multilayer substrate 1.

The structures of the feeding parts having various different shapes and the relationships between the location of the feed line 5*a* and the location of the feeding part 5 corresponding thereto when the antenna is manufactured will be described in detail with reference to FIGS. 25 to 36.

As described above, the dielectric resonator antenna embedded in the multilayer substrate for enhancing bandwidth according to the embodiments of the present invention is advantageous in that there are fewer variations in antenna characteristics in relation to fabrication errors than there are for the conventional patch antenna or stacked patch antenna.

Figure 6:
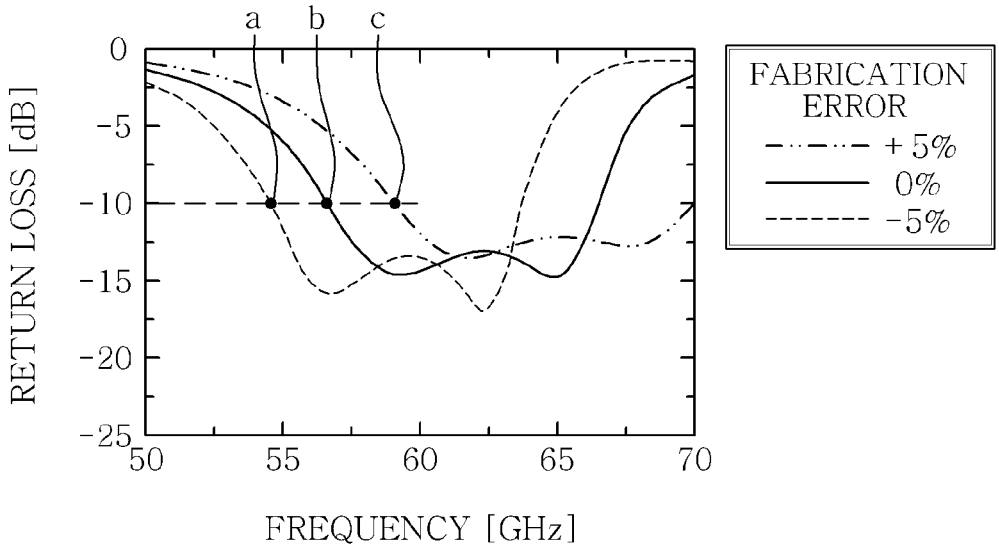
FIG.6 Prior art
FIG. 6 is a simulation graph showing variations in antenna characteristics depending on fabrication errors of a conventional stacked patch antenna.
Figure 7:
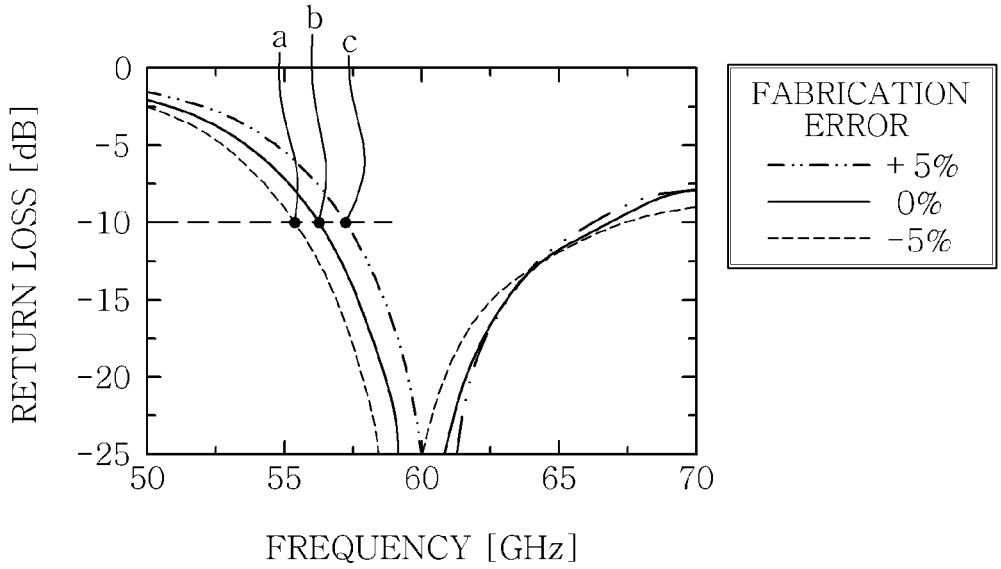
FIG. 7 is a simulation graph showing variations in antenna characteristics depending on fabrication errors of the dielectric resonator antenna embedded in a multilayer substrate for enhancing bandwidth according to an embodiment of the present invention.

Such sensitivities depending on fabrication errors will be compared with reference to the graphs of FIGS. 6 and 7.

FIG. 6 is a simulation graph showing variations in antenna characteristics depending on fabrication errors of the conventional stacked patch antenna.

In this case, the detailed dimensions of the stacked patch antenna used for the simulation are defined as follows. The area of an upper patch is 0.5 mm×0.8 mm, the area of a lower patch 0.4 mm×0.8 mm, the thickness of the substrate between the upper and lower patches is 0.2 mm, the thickness of the substrate between the lower patch and the ground is 0.2 mm, the thickness of the substrate of a feeding part is 0.1 mm, and the permittivity of the substrate is 6.

Here, the return loss depending on frequency curve of the conventional stacked patch antenna is indicated by a solid line, and, together with this, return loss depending on frequency curves, appearing when the dimensions of the stacked patch antenna are adjusted by ±5% on the basis of the dimensions of the antenna at that time, are indicated.

FIG. 7 is a simulation graph showing variations in antenna characteristics depending on fabrication errors of the dielectric resonator antenna embedded in the multilayer substrate for enhancing bandwidth according to an embodiment of the present invention.

In this case, the detailed dimensions of a dielectric resonator antenna used for the simulation are defined as follows. That is, the length of the antenna in an x direction (a) which is parallel to the longitudinal direction of the feed line 5*a* is 0.3 mm, the length of the antenna in a y direction (b) is 0.9 mm, the length of the antenna in a z direction (c) (that is, thickness) is 0.5 mm, and the permittivity of the substrate is 6.

Here, the return loss depending on frequency of the dielectric resonator antenna embedded in the multilayer substrate for enhancing bandwidth according to the embodiment of the present invention is indicated by a solid line, and together with this, return loss depending on frequency curves, appearing when the dimensions of the stacked patch antenna are adjusted by ±5% on the basis of the dimensions of the antenna at that time, are indicated.

Referring to FIGS. 6 and 7, when comparison is made on the basis of the case where return loss is −10 dB, frequency shifts (an interval between points a, b and c shown in FIG. 6) depending on the fabrication errors of the conventional stacked patch antenna are greater than frequency shifts (an interval between points a, b and c shown in FIG. 7) depending on the fabrication errors of the dielectric resonator antenna embedded in the multilayer substrate for enhancing bandwidth according to the embodiment of the present invention.

This means that, as described above, the dielectric resonator antenna embedded in to the multilayer substrate 1 for enhancing bandwidth according to the embodiment of the present invention is less sensitive to fabrication errors than is the conventional stacked patch antenna.

That is, the resonant frequency of the conventional patch antenna or stacked patch antenna is determined by the length of the antenna in the x direction (that is, x direction length) which is parallel to the longitudinal direction of the feed line of the patch antenna.

In contrast, the resonant frequency of the dielectric resonator antenna embedded in the multilayer substrate 1 for enhancing bandwidth according to the embodiment of the present invention is determined by the x direction length (a), y direction length (b) and z direction length (thickness, c), and thus the influence of fabrication errors of one direction on resonant frequency can be reduced.

Figure 8:
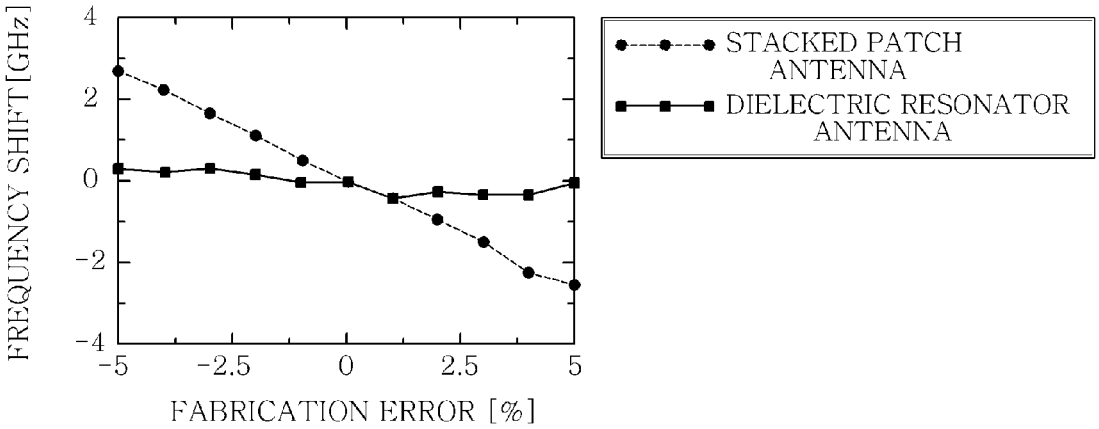
FIG. 8 is a diagram showing the comparison of frequency shifts depending on fabrication errors between the conventional stacked patch antenna and the dielectric resonator antenna of the present invention.

FIG. 8 is a diagram showing the comparison of frequency shifts depending on fabrication errors between the conventional stacked patch antenna and the dielectric resonator antenna of the present invention.

Referring to FIG. 8, the conventional stacked patch antenna is characterized in that frequency shifts are changed in proportion to fabrication errors, but the dielectric resonator antenna embedded in the multilayer substrate for enhancing bandwidth according to the embodiment of the present invention is characterized in that frequency shifts are almost uniform with respect to fabrication errors.

That is, since, in the dielectric resonator antenna of the present invention, the fabrication errors do not greatly influence frequency shifts, it can be considered that the dielectric resonator antenna of the present invention is less sensitive to fabrication errors than is the conventional stacked patch antenna.

Further, the dielectric resonator antenna embedded in the multilayer substrate 1 for enhancing bandwidth according to the present invention has an advantage in that there are fewer variations in antenna characteristics in relation to variations in an external environment than there are for the conventional patch antenna or stacked patch antenna. This will be described in detail with reference to FIGS. 9 to 11.

Figure 9:
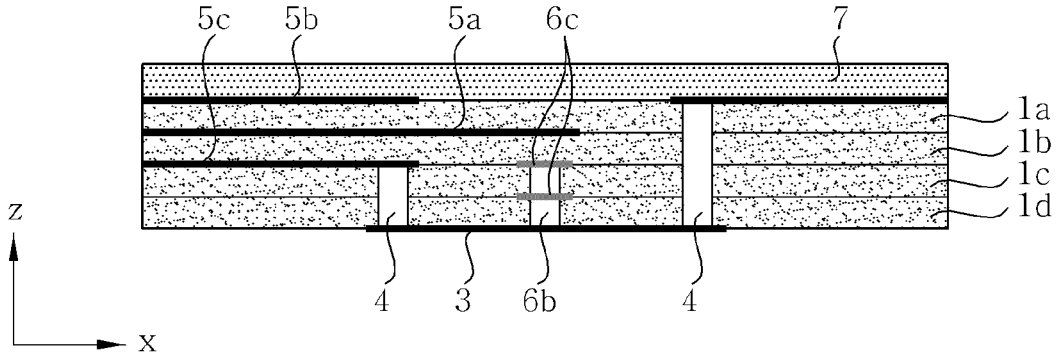
FIG. 9 is a sectional view of a dielectric resonator antenna in which an external dielectric is added to the dielectric resonator antenna of FIGS. 1 to 5.

FIG. 9 is a sectional view of a dielectric resonator antenna in which an external dielectric is added to the dielectric resonator antenna of FIGS. 1 to 5.

Referring to FIG. 9, an external dielectric 7 is added to the radiation opening of the dielectric resonator antenna of FIGS. 1 to 5.

When the external dielectric 7 is added in this way, a definite difference in variations in antenna characteristics depending on an external environment between the conventional patch antenna and the antenna of the present invention can be found by comparing return loss depending on frequency therebetween.

Figure 10:
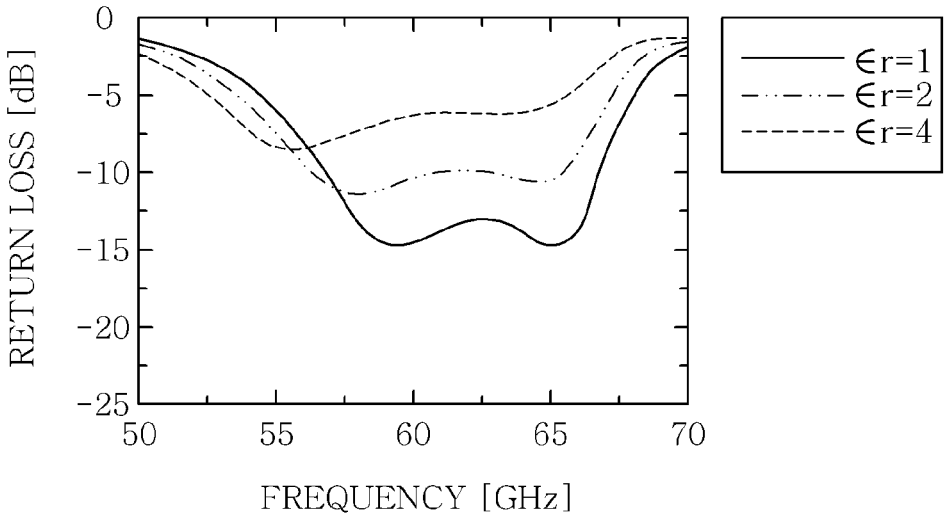
FIG. 10 is a simulation graph showing frequency-based return loss depending on the permittivity ($\in_r$) of an external dielectric when the external dielectric is added to the conventional stacked patch antenna.

FIG. 10 is a simulation graph showing frequency-based return loss depending on the permittivity ($\in_r$) of the external dielectric 7 when the external dielectric 7 is added to the conventional stacked patch antenna.

Here, the conventional stacked patch antenna used for the simulation has the same dimensions as the conventional antenna described with reference to FIG. 6.

Figure 11:
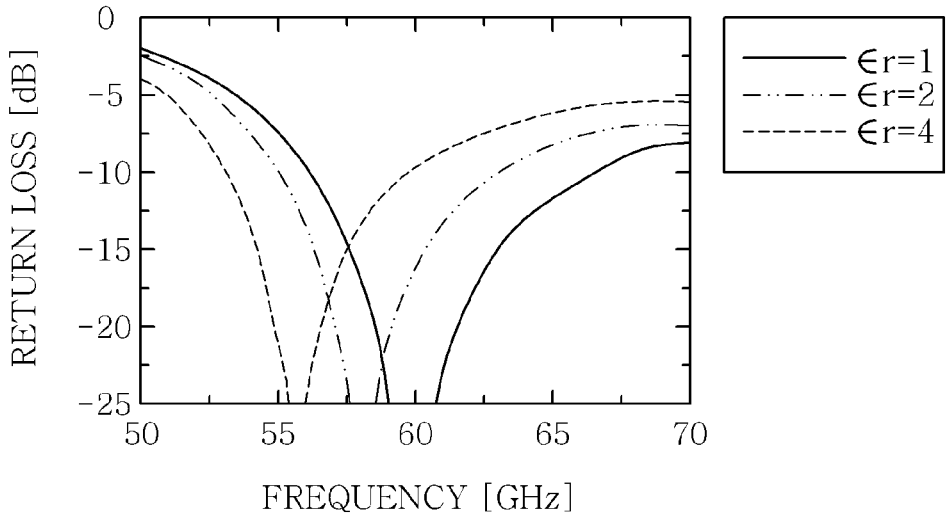
FIG. 11 is a simulation graph showing frequency-based return loss depending on the permittivity ($\in_r$) of an external dielectric when the external dielectric is added to the dielectric resonator antenna of FIGS. 1 to 5.

FIG. 11 is a simulation graph showing frequency-based return loss depending on the permittivity ($\in_r$) of the external dielectric 7 when the external dielectric 7 is added to the dielectric resonator antenna of FIGS. 1 to 5.

Here, the dielectric resonator antenna of the present invention used for the simulation has the same dimensions as the antenna described with reference to FIG. 7.

When FIGS. 10 and 11 are compared to each other, it can be seen that return loss, as well as frequency shifts, greatly change according to the permittivity ($\in_r$) of the external dielectric 7.

That is, as the permittivity ($\in_r$) of the external dielectric 7 is higher on the basis of a point at which return loss is −10 dB, return loss increases.

In particular, when the permittivity ($\in_r$) of the external dielectric 7 is 4 (indicated by a dotted line), the antenna has a return loss of −10 dB or more at all frequencies, and thus antenna characteristics are not good.

In contrast, FIG. 11 shows that there is a shift in resonant frequency according to the permittivity ($\in_r$) of the external dielectric 7, but similar shapes are maintained on the basis of a point at which return loss is −10 dB.

That is, in the dielectric resonator antenna embedded in the multilayer substrate 1 for enhancing bandwidth according to the present invention, even if the permittivity ($\in_1$) of the external dielectric 7 increases, there is only a shift in resonant frequency, but return loss is maintained in an excellent state.

Therefore, it can be seen that there are fewer variations in the antenna characteristics of the dielectric resonator antenna embedded in the multilayer substrate 1 for enhancing bandwidth according to the present invention, in relation to variations in an external environment, than there are for the conventional stacked patch antenna.

Meanwhile, the dielectric resonator antenna embedded in the multilayer substrate 1 according to the embodiment of the present invention is an antenna based on resonance.

Referring to FIGS. 1 to 5, the dielectric resonator antenna embedded in the multilayer substrate 1 for enhancing bandwidth according to the embodiment of the present invention has the shape of a hexahedron, and has a size determined by the x direction length (a), y direction length (b) and z direction length (c) (thickness) thereof. The resonant frequency of such a dielectric resonator antenna is determined according to the size of the dielectric resonator embedded in the multilayer substrate 1.

Further, the dielectric resonator antenna according to the embodiment of the present invention may be operated either in single resonance in which only a single resonant frequency is present in the dielectric resonator antenna or in double resonance in which two resonant frequencies overlap with each other and interact with each other, according to the length (a) of the antenna in the x direction which is parallel to the longitudinal direction of the feed line 5*a* of the feeding part 5.

In detail, the term 'single resonance' means a phenomenon in which only one resonance mode is present in the dielectric resonator antenna according to the x direction length (a) and only a single resonance point occurs at fed frequencies.

Further, the term 'double resonance' means a phenomenon in which two resonance modes coexist in the dielectric resonator antenna according to the x direction length (a) and they overlap and interact with each other, so that two resonance points occur at fed frequencies.

Meanwhile, in the present invention, the term 'single resonance' is assumed to be the case where only a resonance mode having the lowest frequency, that is, a fundamental mode (for example, $TE_{101}$), among a plurality of resonance modes, is present, and then a description will be made under this assumption.

Further, in the present invention, the term 'double resonance' is assumed to be the case where an extra mode (for example, $TM_{111}$) together with the fundamental mode $TE_{101}$ is present, and then a description will be made under this assumption.

Next, when the dielectric resonator antenna embedded in the multilayer substrate 1 for enhancing bandwidth according to the embodiment of the present invention is operated in the fundamental mode $TE_{101}$, and in the extra mode $TM_{111}$, electric field (E-field) distributions of the dielectric resonator antenna will be described with reference to FIGS. 12 to 14 and FIGS. 15 to 17.

In this case, the dielectric resonator antenna according to the present embodiment is shown to include only a dielectric resonator in which the conductive pattern part 6 is not inserted, and the feed line 5*a* to be inserted into the dielectric resonator is also omitted.

Figure 12:
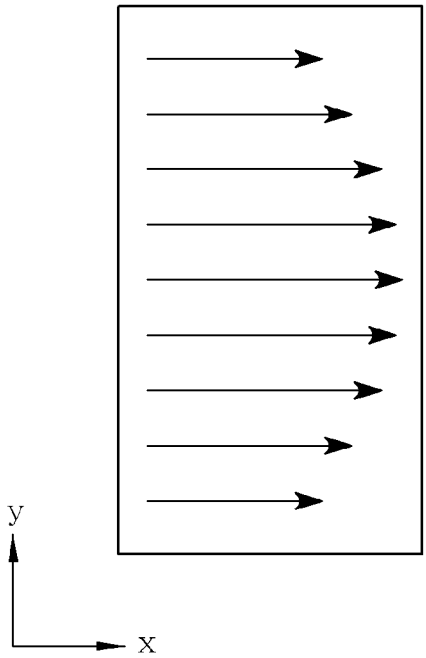
FIG. 12 is a diagram showing an Electric field (E-field) distribution in an x-y plane among E-field distributions of the dielectric resonator antenna operating in a fundamental mode $TE_{101}$.
Figure 13:
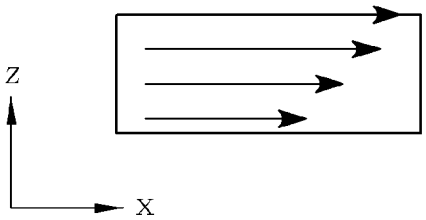
FIG. 13 is a diagram showing an E-field distribution in an x-z plane among E-field distributions of the dielectric resonator antenna operating in the fundamental mode $TE_{101}$.
Figure 14:
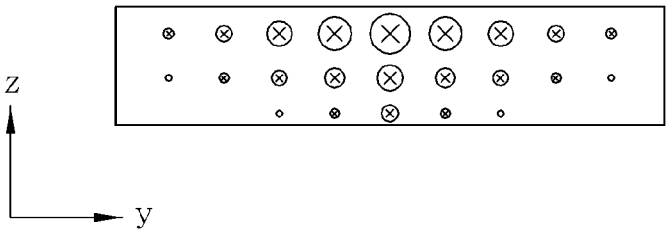
FIG. 14 is a diagram showing an E-field distribution in a y-z plane among E-field distributions of the dielectric resonator antenna operating in the fundamental mode $TE_{101}$.

FIG. 12 is a diagram showing an Electric field (E-field) distribution in an x-y plane among E-field distributions of the dielectric resonator antenna operating in the fundamental mode $TE_{101}$, FIG. 13 is a diagram showing an E-field distribution in an x-z plane among E-field distributions of the dielectric resonator antenna operating in the fundamental mode $TE_{101}$, and FIG. 14 is a diagram showing an E-field distribution in a y-z plane among E-field distributions of the dielectric resonator antenna operating in the fundamental mode $TE_{101}$.

Referring to FIGS. 12 to 14, it can be seen that in the fundamental mode $TE_{101}$, the dielectric resonator antenna has a uniform E-field distribution in the x direction which is parallel to the longitudinal direction of the feed line 5*a* of the feeding part 5.

Figure 15:
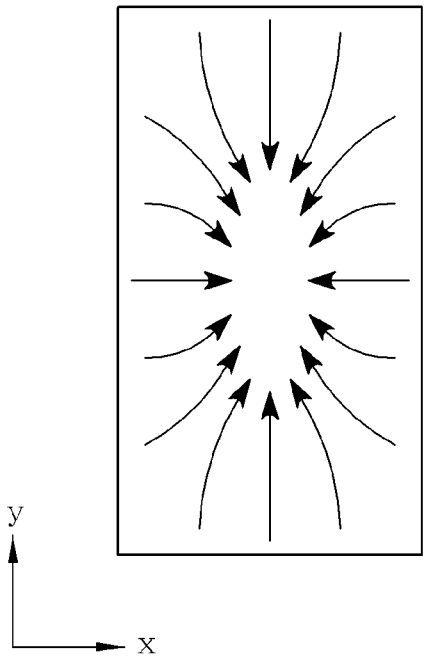
FIG. 15 is a diagram showing an E-field distribution in an x-y plane among E-field distributions of the dielectric resonator antenna operating in an extra mode $TM_{111}$.
Figure 16:
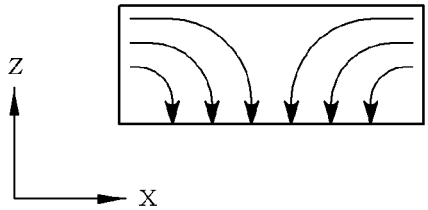
FIG. 16 is a diagram showing an E-field distribution in an x-z plane among E-field distributions of the dielectric resonator antenna operating in the extra mode $TM_{111}$.
Figure 17:
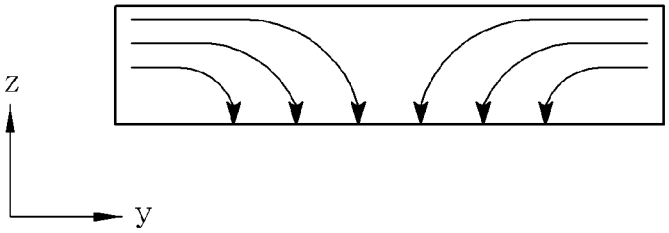
FIG. 17 is a diagram showing an E-field distribution in a y-z plane among E-field distributions of the dielectric resonator antenna operating in the extra mode $TM_{111}$.

FIG. 15 is a diagram showing an E-field distribution in an x-y plane among E-field distributions of the dielectric resonator antenna operating in an extra mode $TM_{111}$, FIG. 16 is a diagram showing an E-field distribution in an x-z plane among E-field distributions of the dielectric resonator antenna operating in the extra mode $TM_{111}$, and FIG. 17 is a diagram showing an E-field distribution in a y-z plane among E-field distributions of the dielectric resonator antenna operating in the extra mode $TM_{111}$.

Referring to FIGS. 15 to 17, it can be seen that unlike in the fundamental mode $TE_{101}$, in the extra mode $TM_{111}$, the dielectric resonator antenna has an E-field distribution in which an x direction E-field and a −x direction E-field are distributed in the −z direction from the center of the dielectric resonator antenna.

Figure 18:
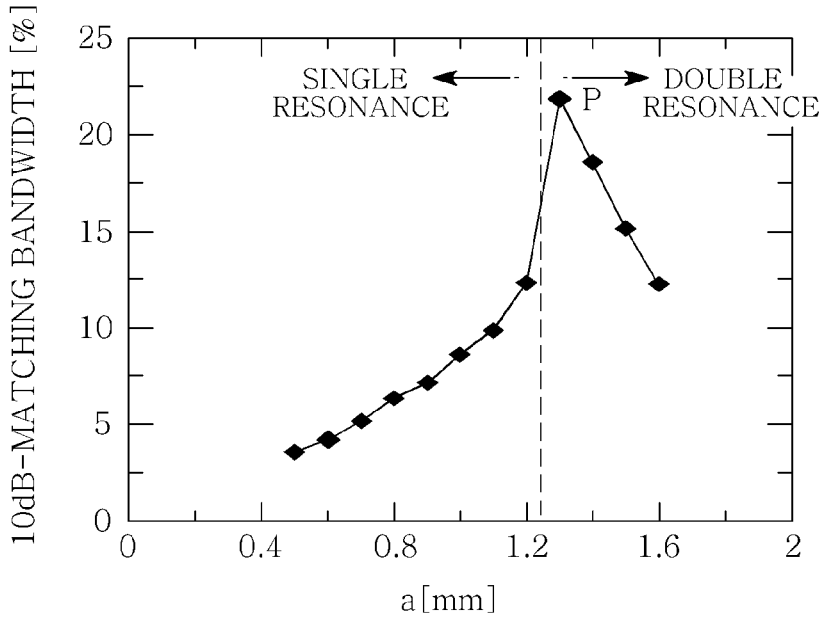
FIG. 18 is a simulation graph showing the relationships between the x direction length (a) and the bandwidth of the dielectric resonator antenna embedded in a multilayer substrate for enhancing bandwidth according to an embodiment of the present invention.

FIG. 18 is a simulation graph showing the relationship between the x direction length (a) and the bandwidth of the dielectric resonator antenna embedded in the multilayer substrate 1 for enhancing bandwidth according to an embodiment of the present invention.

Here, the detailed dimensions of the dielectric resonator antenna used for the simulation are defined as follows. That is, the y direction length (b) of the antenna is 0.9 mm, the z direction length (c) (thickness) is 0.5 mm, and the permittivity of a substrate is 6.

Referring to FIG. 18, as the x direction length (a) increases, the dielectric resonator antenna is operated in single resonance ($TE_{101}$) on the left side of a dotted line near about 1.2 mm and is operated in double resonance ($TE_{101}$+$TM_{111}$) on the right side of the dotted line.

Whether the dielectric resonator antenna is operated in single resonance ($TE_{101}$) or in double resonance ($TE_{101}$+$TM_{111}$) can be determined by measuring return loss depending on frequency.

Figure 19:
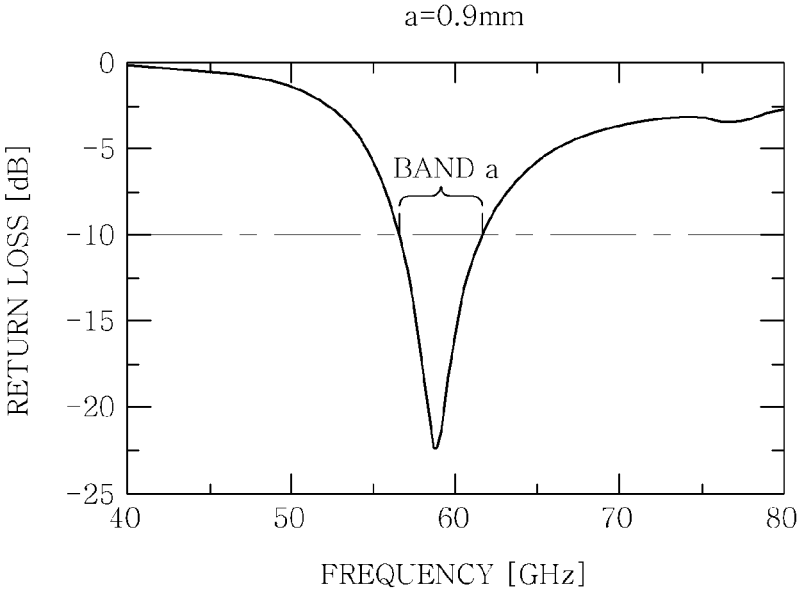
FIGS. 19 to 21 are simulation graphs showing the return loss depending on x direction length (a) of the dielectric resonator antenna embedded in a multilayer substrate for enhancing bandwidth according to an embodiment of the present invention.
Figure 20:
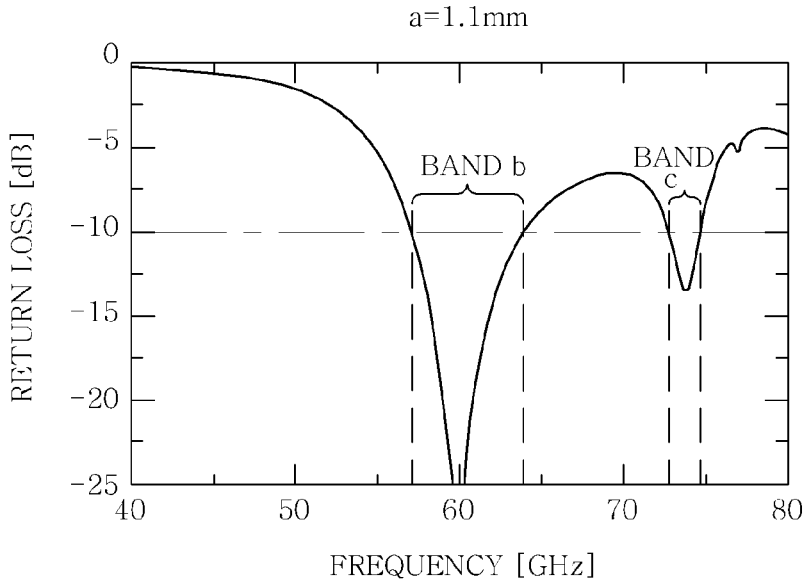
Figure 21:
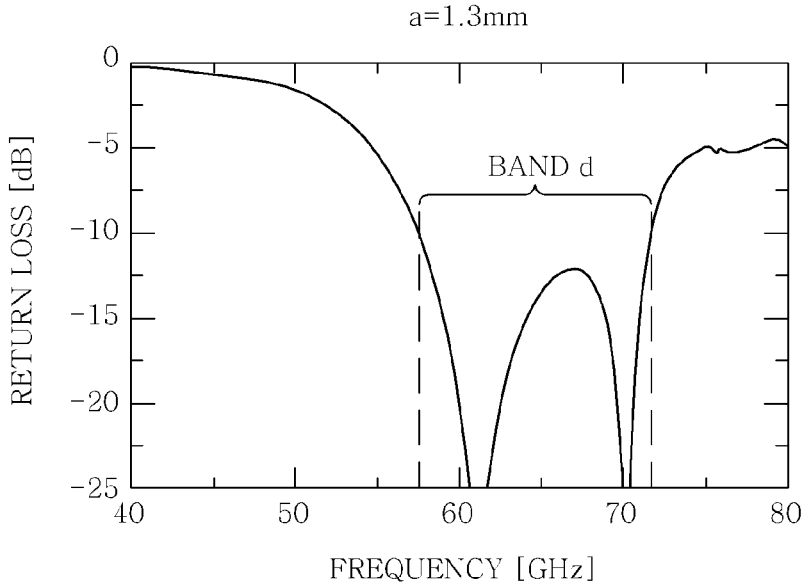

FIGS. 19 to 21 are simulation graphs showing the return loss depending on x direction length (a) of the dielectric resonator antenna embedded in the multilayer substrate 1 for enhancing bandwidth according to an embodiment of the present invention. In the drawings, the x direction length (a) is sequentially set to a=0.9 mm, 1.1 mm and 1.3 mm Detailed dimensions of the dielectric resonator antenna used for the present simulation are the same as those described with reference to FIG. 18.

Figure 22:
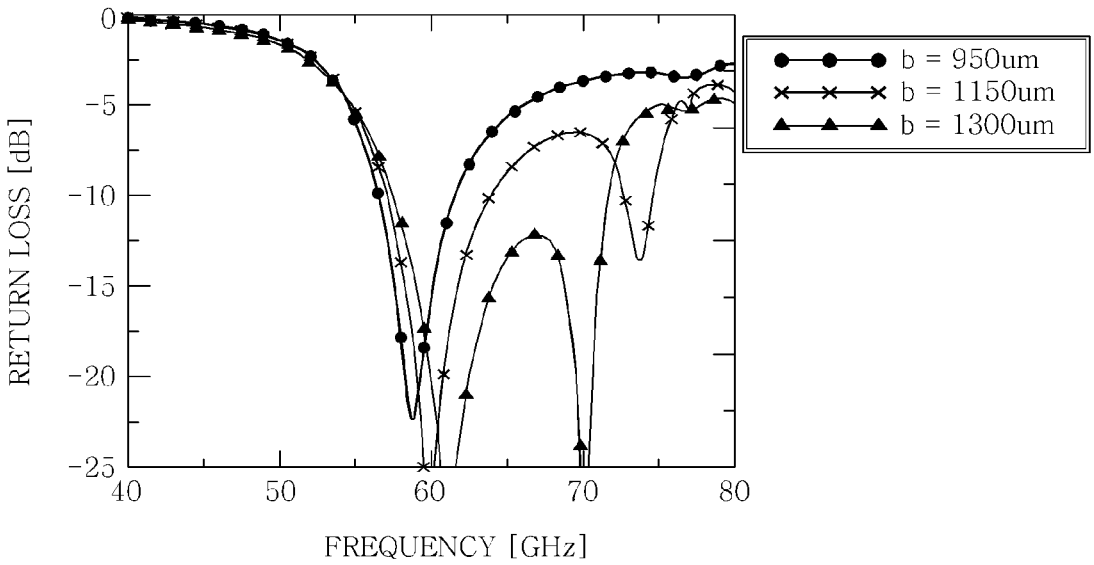
FIG. 22 is a diagram integrally showing graphs of respective reflective coefficients of FIGS. 19 to 21 to compare antenna characteristics depending on variations in the x direction length (a)

FIG. 22 is a diagram integrally showing graphs of respective reflective coefficients of FIGS. 19 to 21 to compare antenna characteristics depending on variations in the x direction length (a).

Referring to FIG. 19, it can be seen that when the x direction length (a) is 0.9 mm, the dielectric resonator antenna resonates at a frequency of about 60 GHz.

Accordingly, in FIG. 19, when the range of the operation of the antenna is considered on the basis of −10 dB, the antenna resonates only in a band around 60 GHz (band 'a'), and thus the antenna is operated in single resonance ($TE_{101}$).

Referring to FIG. 20, it can be seen that when the x direction length (a) is 1.1 mm, the dielectric resonator antenna resonates at a frequency of about 60 GHz and a frequency of about 70 GHz.

However, in the case of FIG. 20, when the range of the operation of the antenna is considered on the basis of −10 dB, the dielectric resonator antenna resonates twice in a band around the frequency of 60 GHz (band 'b') and a band around the frequency of 70 GHz (band 'c'), but resonance does not occur between the band 'b' and the band 'c', and thus this resonance is considered to be single resonance ($TE_{101}$), rather than double resonance ($TE_{101}$+$TM_{111}$).

Further, FIG. 20 shows that, compared to FIG. 19, bandwidth is further widened (band 'b'>band 'a').

Referring to FIG. 21, it can be seen that when the x direction length (a) is 1.3 mm, the dielectric resonator antenna also resonates at a frequency of about 60 GHz and a frequency of about 70 GHz.

However, in the case of FIG. 21, when the range of the operation of the antenna is considered on the basis of −10 dB, the dielectric resonator antenna resonates in the entire band ranging from about 60 GHz to about 70 GHz (band 'd'), and thus the antenna is operated in double resonance ($TE_{101}$+$TM_{111}$) unlike the case of FIG. 20.

Further, FIG. 21 also shows that, compared to FIGS. 19 and 20, bandwidth is widened by a lot more (band 'd'>band 'b'>band 'a').

Referring to FIG. 22, it can be seen that as the x direction length (a) of the dielectric resonator antenna increases, single resonance ($TE_{101}$) and double resonance ($TE_{101}$+$TM_{111}$) occur, and that when double resonance ($TE_{101}$+$TM_{111}$) occurs compared to single resonance ($TE_{101}$), bandwidth is further widened.

When such a dielectric resonator antenna is operated in the fundamental mode $TE_{101}$, resonant frequency f is given by the following Equation (1).

$$f = \frac{c}{2\pi\sqrt{\varepsilon_r}}\sqrt{\left(\frac{\pi}{b}\right)^2 + \left(\frac{\pi}{2c}\right)^2} \tag{1}$$

Referring to Equation (1), the resonant frequency f of the dielectric resonator antenna is determined by the y direction length (b) and the thickness (c), and is not influenced by the x direction length (a).

The reason for this is that, as described above with reference to FIGS. 12 to 14, when the dielectric resonator antenna is in the fundamental mode $TE_{101}$, a uniform E-field distribution is obtained in the x direction which is parallel to the longitudinal direction of the feed line 5*a* of the feeding part 5.

Further, when the x direction length (a) increases in the fundamental mode $TE_{101}$, a quality factor Q decreases due to an increase in the area of a radiation surface. A decrease in the Q factor means that the bandwidth has increased.

Referring to FIG. 18, it can be seen that when the dielectric resonator antenna is operated in the single resonance of the fundamental mode $TE_{101}$, 10 dB-matching bandwidth increases as the x direction length (a) increases.

However, when the x direction length (a) continuously increases above the length indicated by a dotted line, the dielectric resonator antenna has double resonance ($TE_{101}$+$TM_{111}$).

When such a dielectric resonator antenna is operated in double resonance ($TE_{101}$+$TM_{111}$), resonant frequency f in the extra mode $TM_{111}$ corresponding to the second resonance of double resonance is given by the following Equation (2).

$$f = \frac{c}{2\pi\sqrt{\varepsilon_r}}\sqrt{\left(\frac{\pi}{a}\right)^2 + \left(\frac{\pi}{b}\right)^2 + \left(\frac{\pi}{2c}\right)^2} \quad (2)$$

Referring to Equation (2), the resonant frequency f of the dielectric resonator antenna is determined by all of the x direction length (a), the y direction length (b) and the z direction length (c) (thickness), unlike in the fundamental mode $TE_{101}$.

The reason for this is that, as described above with reference to FIGS. 15 to 17, when the dielectric resonator antenna is operated in the extra mode $TM_{111}$, the dielectric resonator antenna has an E-field distribution in which an x direction E-field and a −x direction E-field are distributed to the −z direction from the center of the antenna.

Referring back to FIG. 18, it can be seen that when the dielectric resonator antenna is operated in double resonance ($TE_{101}$+$TM_{111}$), 10 dB-matching bandwidth gradually increases up to a point P, but sharply decreases after the point P, as the x direction length (a) increases.

In this way, the dielectric resonator antenna is operated in double resonance ($TE_{101}$+$TM_{111}$) by increasing the x direction length (a), thus increasing the bandwidth.

However, in the case of the dielectric resonator antenna operated in double resonance ($TE_{101}$+$TM_{111}$), there occurs a phenomenon in which two modes overlap with each other and then the bandwidth increases irregularly.

In other words, in the case of double resonance ($TE_{101}$+$TM_{111}$), E-plane radiation patterns at two resonant frequencies are different from each other, and thus the entire radiation pattern is irregularly deformed.

Figure 23:
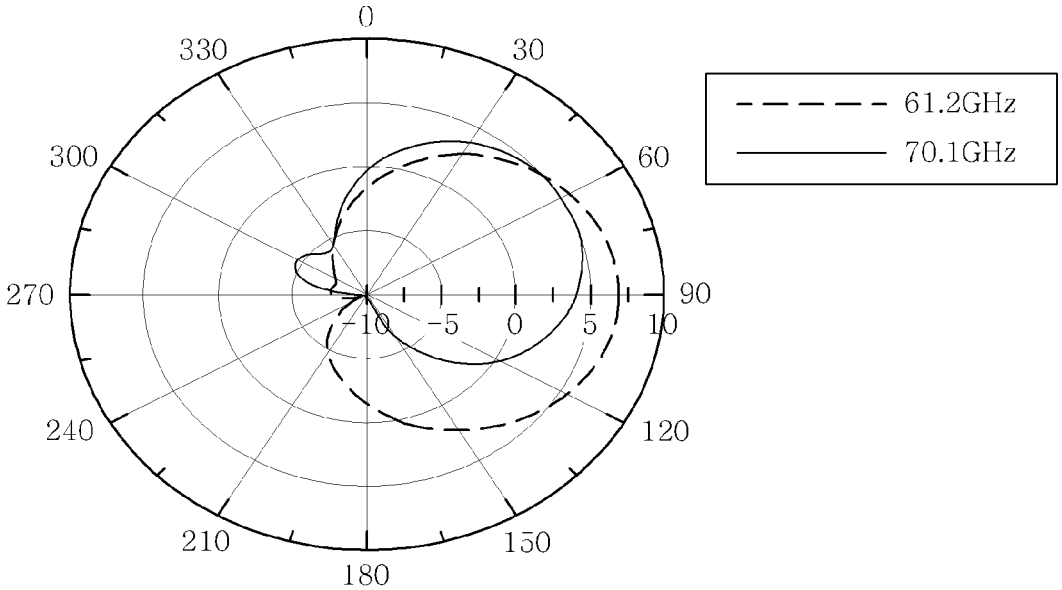
FIG. 23 is a diagram showing the E-plane radiation pattern of the dielectric resonator antenna, operating in double resonance ($TE_{101}$+$TM_{111}$), at −10 dB matching frequency before a conductive pattern part is inserted into a dielectric resonator.

FIG. 23 is a diagram showing the E-plane radiation pattern of the dielectric resonator antenna, operating in double resonance ($TE_{101}$+$TM_{111}$), at −10 dB matching frequency before the conductive pattern part 6 is inserted into the dielectric resonator.

Referring to FIG. 23, it can be seen that, in the dielectric resonator antenna, radiation patterns at two resonant frequencies (61.2 GHz and 70.1 GHz) are not identical to each other.

The fact that the radiation patterns are not identical to each other indicates that reception sensitivity is not uniform and much noise occurs, thus consequently meaning that antenna characteristics are deteriorated.

Figure 24:
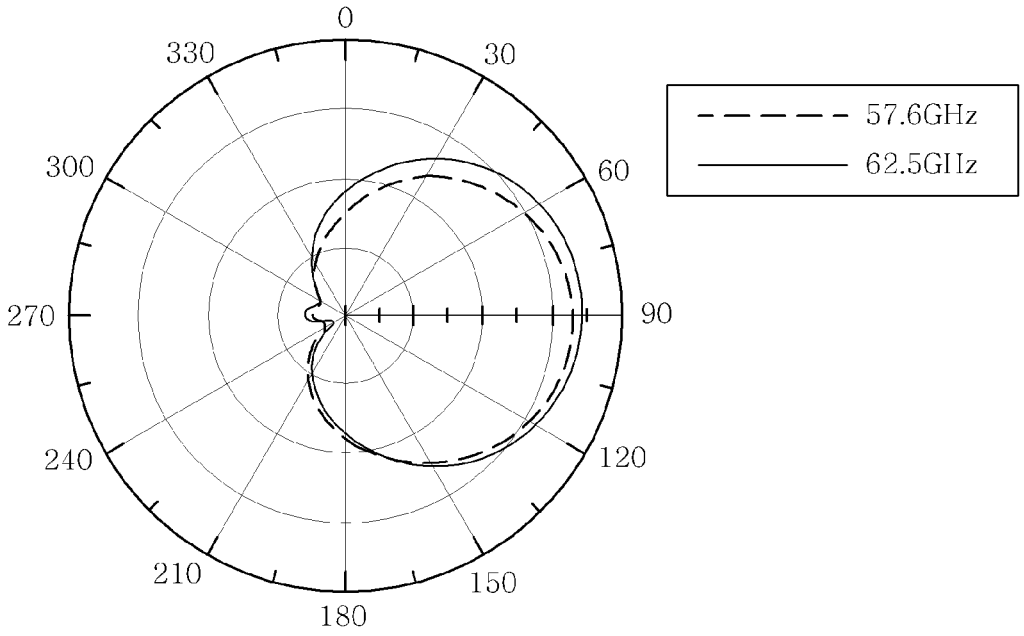
FIG. 24 is a diagram showing the E-plane radiation pattern of the dielectric resonator antenna, into which the conductive pattern part has been inserted, at −10 dB matching frequency.

FIG. 24 is a diagram showing the E-plane radiation pattern of the dielectric resonator antenna, into which the conductive pattern part 6 which will be described later has been inserted, at −10 dB matching frequency.

Referring to FIG. 24, it can be seen that the dielectric resonator antenna has almost the same radiation patterns at two resonant frequencies (57.6 GHz and 62.5 GHz).

When FIGS. 23 and 24 are compared to each other, the bandwidth of FIG. 23 is wider than that of FIG. 24, whereas the radiation characteristics of FIG. 24 are more excellent than those of FIG. 23.

Therefore, in the case of the dielectric resonator antenna which is operated in double resonance ($TE_{101}$+$TM_{111}$), the conductive pattern part 6 is inserted into the dielectric resonator so as to eliminate the extra mode $TM_{111}$ and enhance the radiation characteristics of the antenna.

When the conductive pattern part 6 is inserted into the dielectric resonator, a tangential field of an E-field formed in the dielectric resonator (refer to FIGS. 15 to 17) is eliminated and a normal field is maintained in double resonance ($TE_{101}$+$TM_{111}$), thus enabling only extra mode $TM_{111}$ to be effectively eliminated.

Since the dielectric resonator antenna has a strong E-field at the center of the dielectric resonator in double resonance, it is most preferable to dispose such a conductive pattern part 6 at the center (a/2) of the x direction length (a).

In detail, referring back to FIGS. 1 to 5, the conductive pattern part 6 is formed on the bottom of the at least one insulating layer which is formed downwards on the bottom of the feed line 5*a* so that a vertical metal interface intersecting the feed line 5*a* is formed in the dielectric resonator.

Such a conductive pattern part 6 includes a plurality of second metal via holes 6*b* vertically formed through the multilayer substrate 1 within the dielectric resonator, and one or more third conductive plates 6*a* and 6*c* formed to be coupled to the second metal via holes 6*b* between the insulating layers 1*a* to 1*d* through which the second metal via holes 6*b* are formed.

The conductive pattern part 6 enables the vertical metal interface, which intersects the feed line 5*a*, to be formed in the dielectric resonator by the plurality of second metal via holes 6*b* and the one or more third conductive plates 6*a* and 6*c* in the form of a net-shaped conductive pattern, as shown in FIG. 5.

Referring to FIG. 5, the second metal via holes 6*b* must be formed below at least one insulating layer, which is formed downwards on the bottom of the feed line 5*a*, on the basis of the feed line 5*a*.

Further, the second metal via holes 6*b* may be formed in all insulating layers on left and right sides of the feed line 5*a*.

However, the second metal via holes 6*b* should not be formed in specific portions of all insulating layers, which range from the feed line 5*a* to the opening and correspond to a location just above the feed line 5*a*.

In FIG. 5, the entire shape of the conductive pattern part 6 is shown as a horseshoe shape, but the shape of the conductive pattern part is not limited to this shape and may be formed in various shapes including a rectangular shape.

Meanwhile, a feeding part for applying a high-frequency signal to a conventional dielectric resonator antenna manufactured outside a substrate may be most ideally implemented using a method of applying current by inserting a metal probe into the dielectric resonator.

However, for the facilitation of the manufacture of the antenna, a feeding method using coupling between a transmission line manufactured inside the substrate and the dielectric resonator manufactured outside the substrate is used.

In contrast, the stripline, microstrip line or CPW line feeding part 5 having a multilayer structure is easily implemented because the dielectric resonator which is an antenna radiator is embedded in the multilayer substrate 1.

Hereinafter, the structures of the above-described feeding parts having various shapes and the relationships between the locations of the feeding parts and the locations of the feed lines corresponding thereto will be described in detail with reference to FIGS. 25 to 36.

Figure 25:
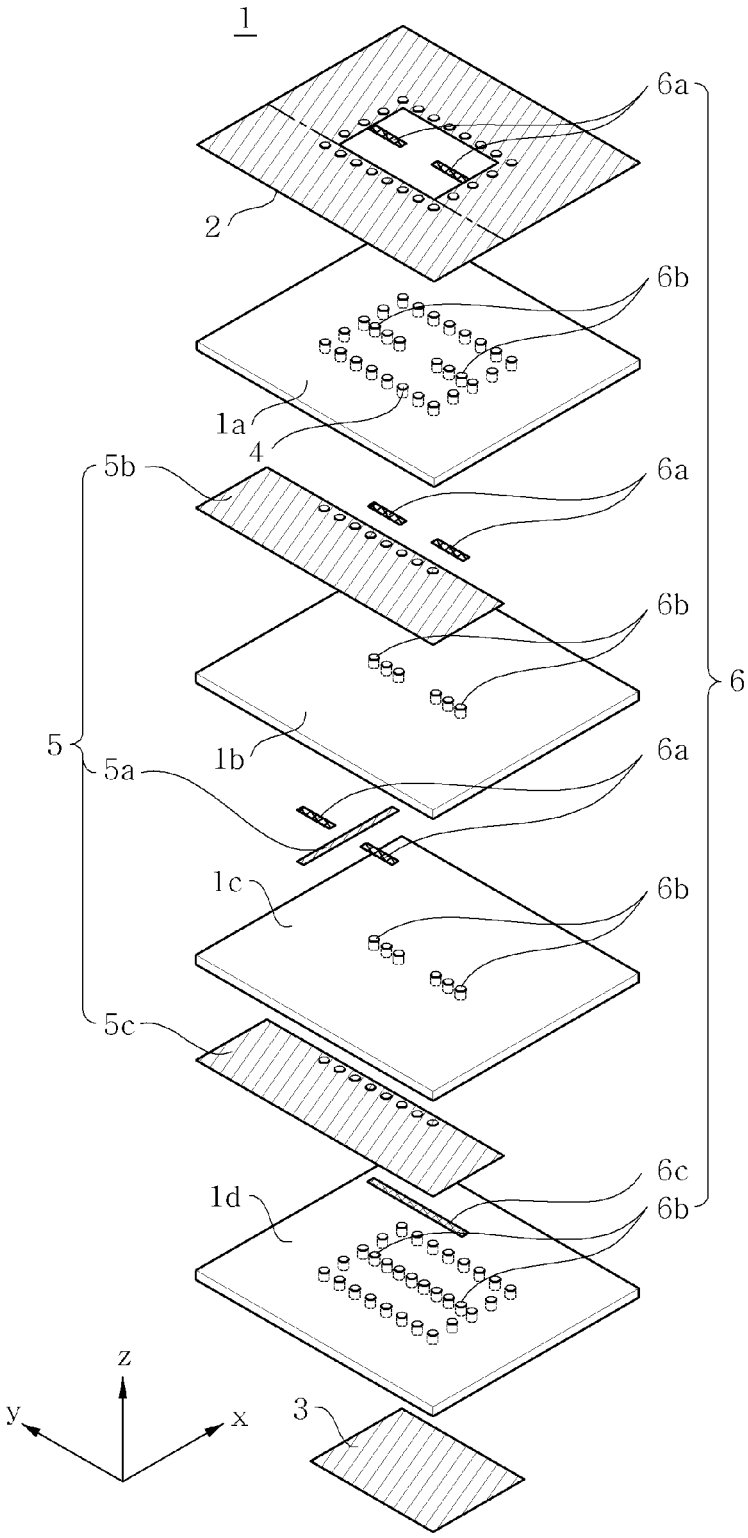
FIG. 25 is an exploded perspective view of a dielectric resonator antenna having a stripline feeding part among various feeding parts of the dielectric resonator antenna embedded in a multilayer substrate for enhancing bandwidth according to an embodiment of the present invention.
Figure 26:
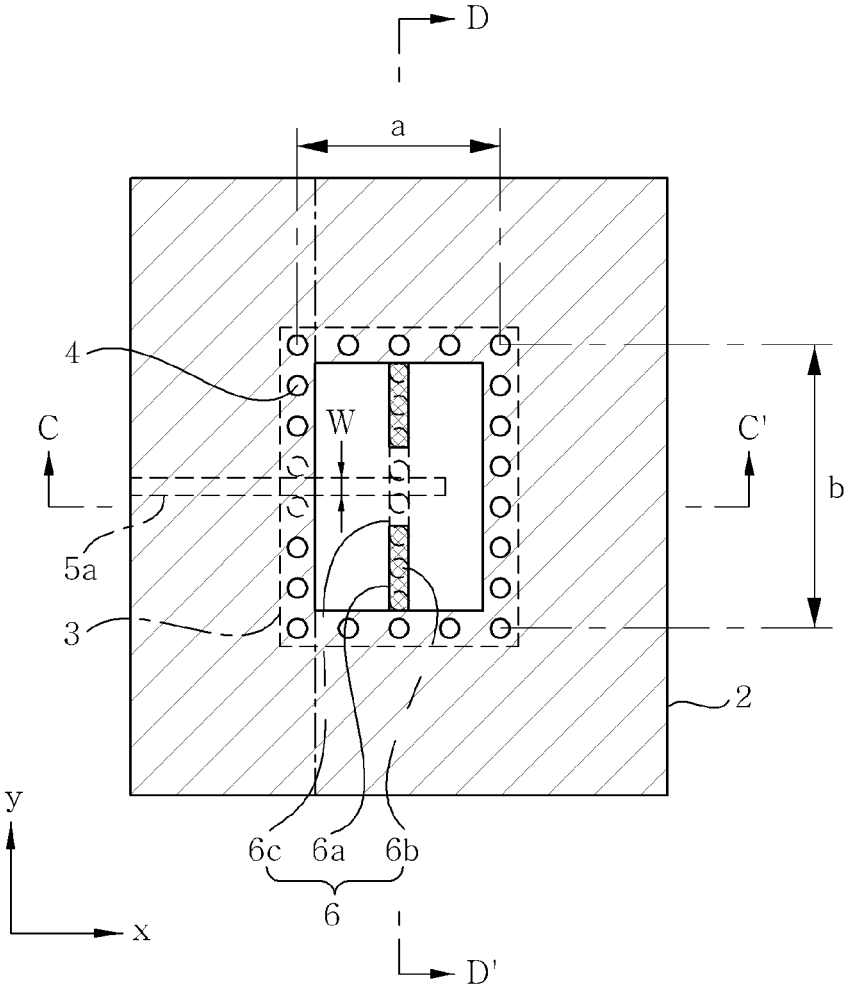
FIG. 26 is a top view of the dielectric resonator antenna of FIG. 25.
Figure 27:
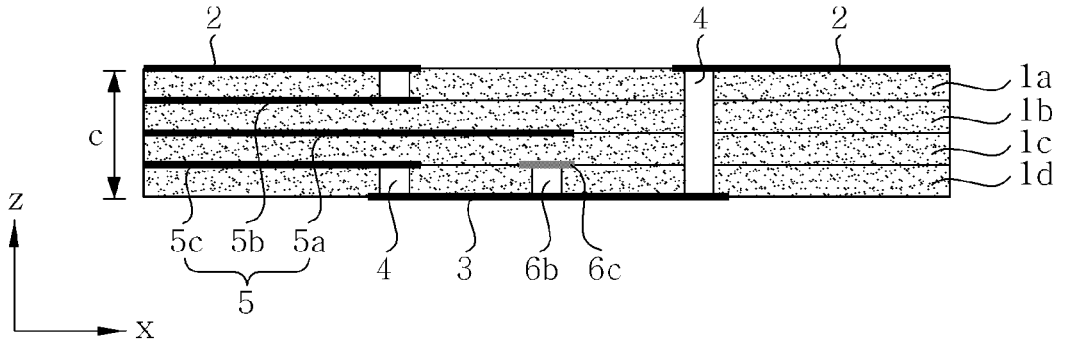
FIG. 27 is a sectional view of the dielectric resonator antenna of FIG. 25 taken along line C-C' of FIG. 26.
Figure 28:
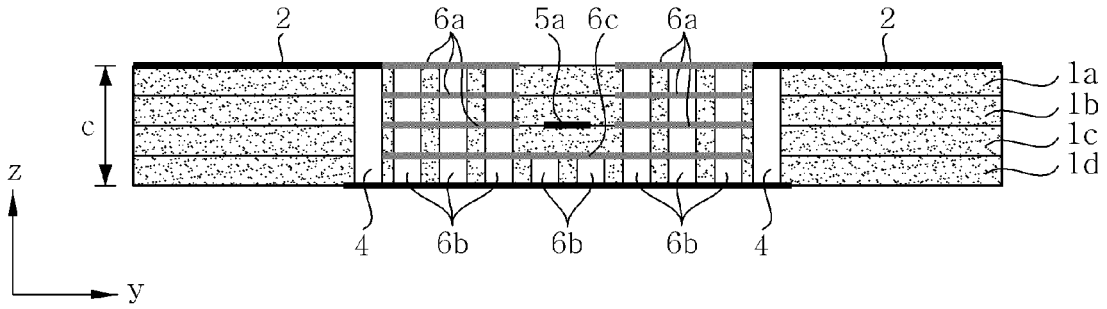
FIG. 28 is a sectional view of the dielectric resonator antenna of FIG. 25 taken along line D-D' of FIG. 26.

FIGS. 25 to 28 are diagrams showing an example in which the feeding part 5 of the dielectric resonator antenna embedded in the multilayer substrate 1 for enhancing bandwidth is implemented using a stripline, among various structures of the feeding part 5 according to an embodiment of the present invention. FIG. 25 is an exploded perspective view of a dielectric resonator antenna having a stripline feeding part, FIG. 26 is a top view of the dielectric resonator antenna of FIG. 25, FIG. 27 is a sectional view of the dielectric resonator antenna of FIG. 25 taken along line C-C' of FIG. 26, and FIG. 28 is a sectional view of the dielectric resonator antenna of FIG. 25 taken along line D-D' of FIG. 26.

The feeding parts of the dielectric resonator antenna shown in FIGS. 25 to 28 are similar to that of the feeding part 5 of FIG. 1, except for the location of the feed line 5*a* in the feeding part 5 of the dielectric resonator antenna of FIG. 1, and thus a detailed description of individual components thereof will be omitted.

When the feeding part 5 of FIG. 1 is compared to the feeding parts 5 of FIGS. 25 to to 28, there is a difference in the location of the feed line 5*a*.

In FIG. 1, the feed line 5*a* is disposed between the first insulating layer 1*a* and the second insulating layer 1*b*, whereas the feed line 5*a* of FIGS. 25 to 28 is disposed between the second insulating layer 1*b* and the third insulating layer 1*c*.

In this way, the stripline feeding part 5 is configured to include the feed line 5*a* and first and second ground plates 5*b* and 5*c* respectively formed on the top and bottom of at least one upper insulating layer and at least one lower insulating layer which are respectively formed upwards and downwards on the feed line 5*a*.

Therefore, according to the location of the feed line 5*a*, the locations of the first and second ground plates 5*b* and 5*c* can be changed, and the feed line 5*a* can be disposed at any location between the bottom of the uppermost insulating layer 1*a* and the top of the lowermost insulating layer 1*d*.

Figure 29:
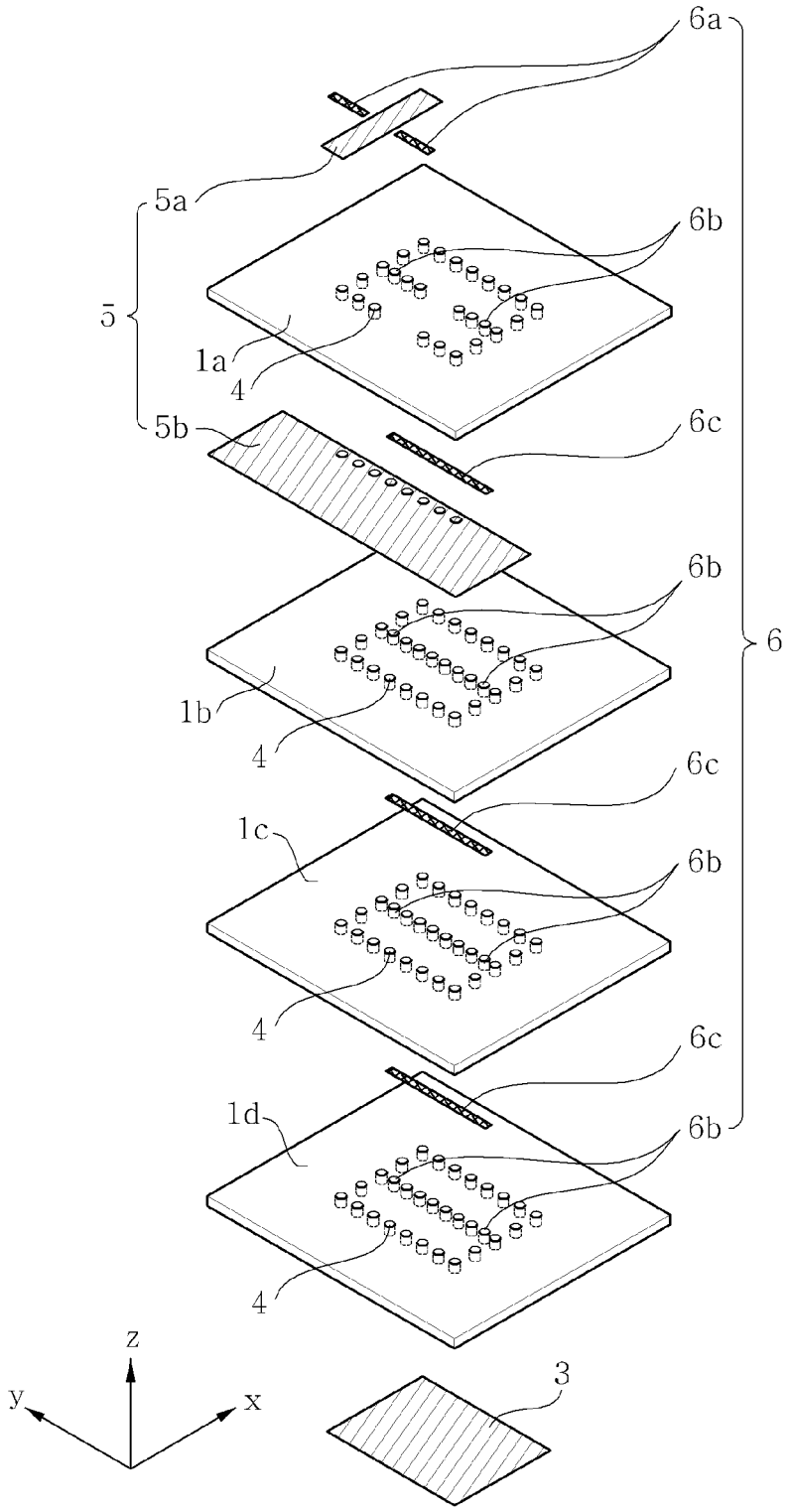
FIG. 29 is an exploded perspective view of a dielectric resonator antenna having a microstrip line feeding part among various feeding parts of the dielectric resonator antenna embedded in a multilayer substrate for enhancing bandwidth according to an embodiment of the present invention.
Figure 30:
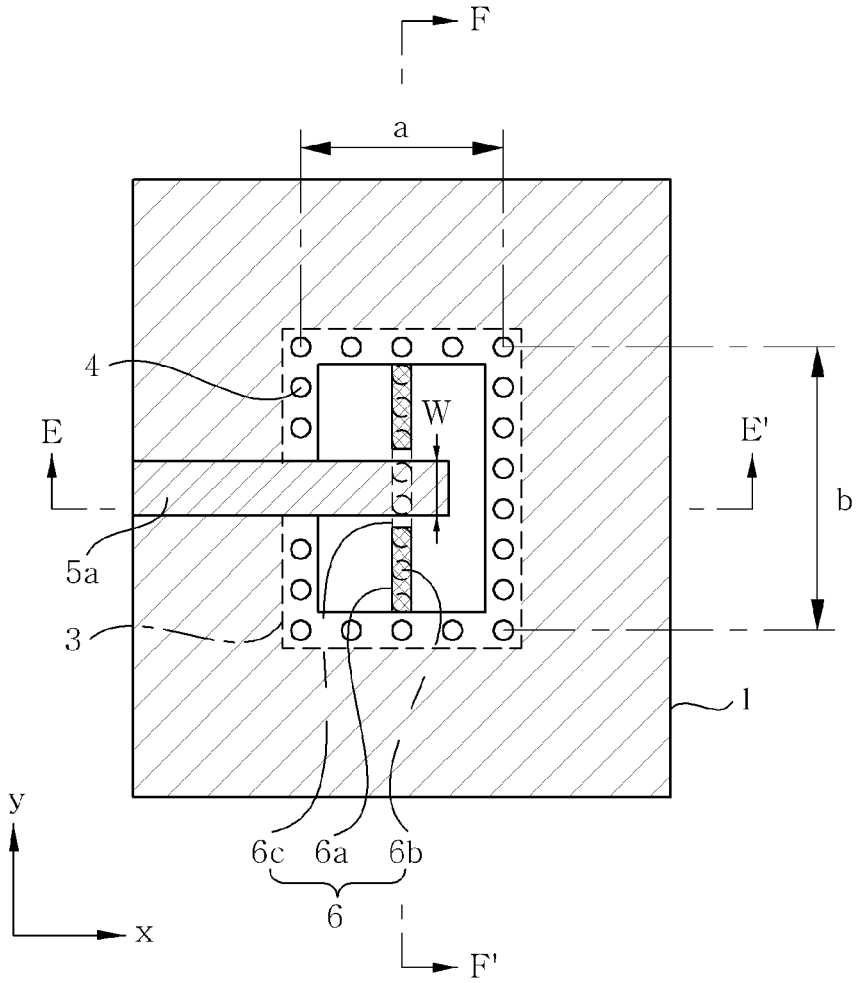
FIG. 30 is a top view of the dielectric resonator antenna of FIG. 29.
Figure 31:
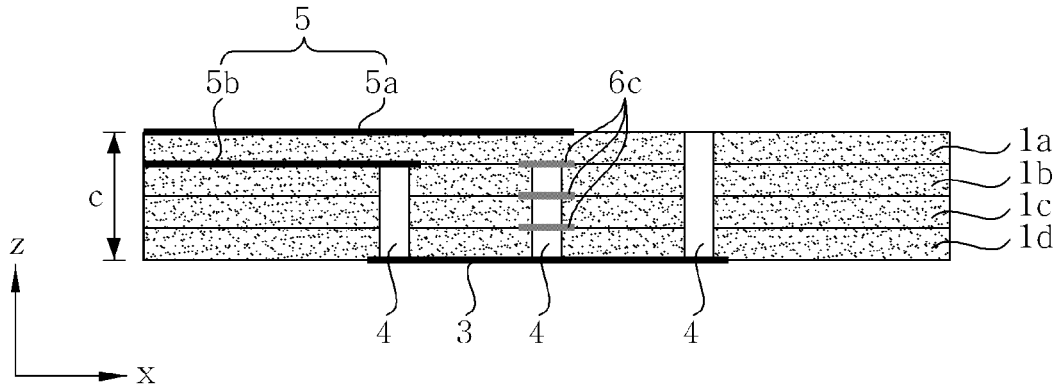
FIG. 31 is a sectional view of the dielectric resonator antenna of FIG. 29 taken along line E-E' of FIG. 30.
Figure 32:
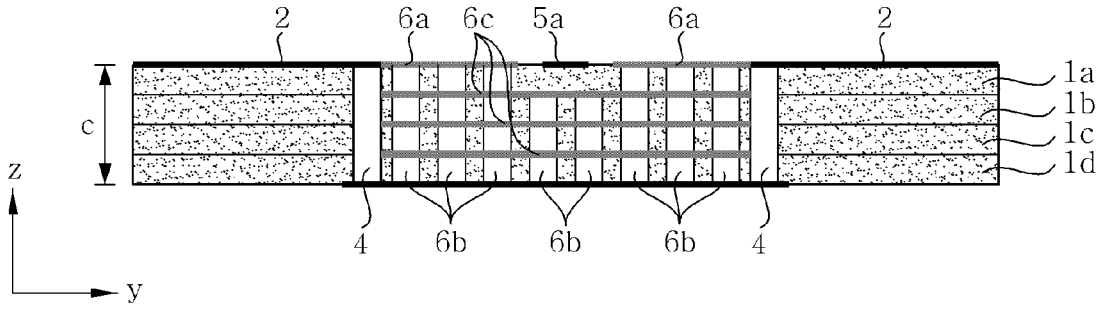
FIG. 32 is a sectional view of the dielectric resonator antenna of FIG. 29 taken along line F-F' of FIG. 30.

Next, FIGS. 29 to 32 are diagrams showing an example in which the feeding part 5 of the dielectric resonator antenna embedded in the multilayer substrate 1 for enhancing bandwidth is implemented using a microstrip line, among various structures of the feeding part 5 according to an embodiment of the present invention. FIG. 29 is an exploded perspective view of the dielectric resonator antenna having a microstrip line feeding part 5, FIG. 30 is a top view of the dielectric resonator antenna of FIG. 29, FIG. 31 is a sectional view of the dielectric resonator antenna of FIG. 29 taken along line E-E' of FIG. 30, and FIG. 32 is a sectional view of the dielectric resonator antenna of FIG. 29 taken along line F-F' of FIG. 30.

The microstrip line feeding part 5 of FIGS. 29 to 32 includes a feed line 5*a* which is formed as a linear conductive plate extending from one side surface of a dielectric resonator so that the feed line 5*a* is inserted into the dielectric resonator to be level with the opening of the dielectric resonator.

Further, the feeding part 5 includes a ground plate 5*b* which is located to correspond to the feed line 5*a* and is formed on the bottom of at least one insulating layer 1*a* formed to downwards on the bottom of the feed line 5*a*.

In this case, in the microstrip line feeding part 5, an end portion of the feed line 5*a* is basically formed in a line shape, but may also be formed in a step shape 5*a*-1, a taper shape 5*a*-2 or a round shape 5*a*-3, as shown in FIG. 3.

Figure 33:
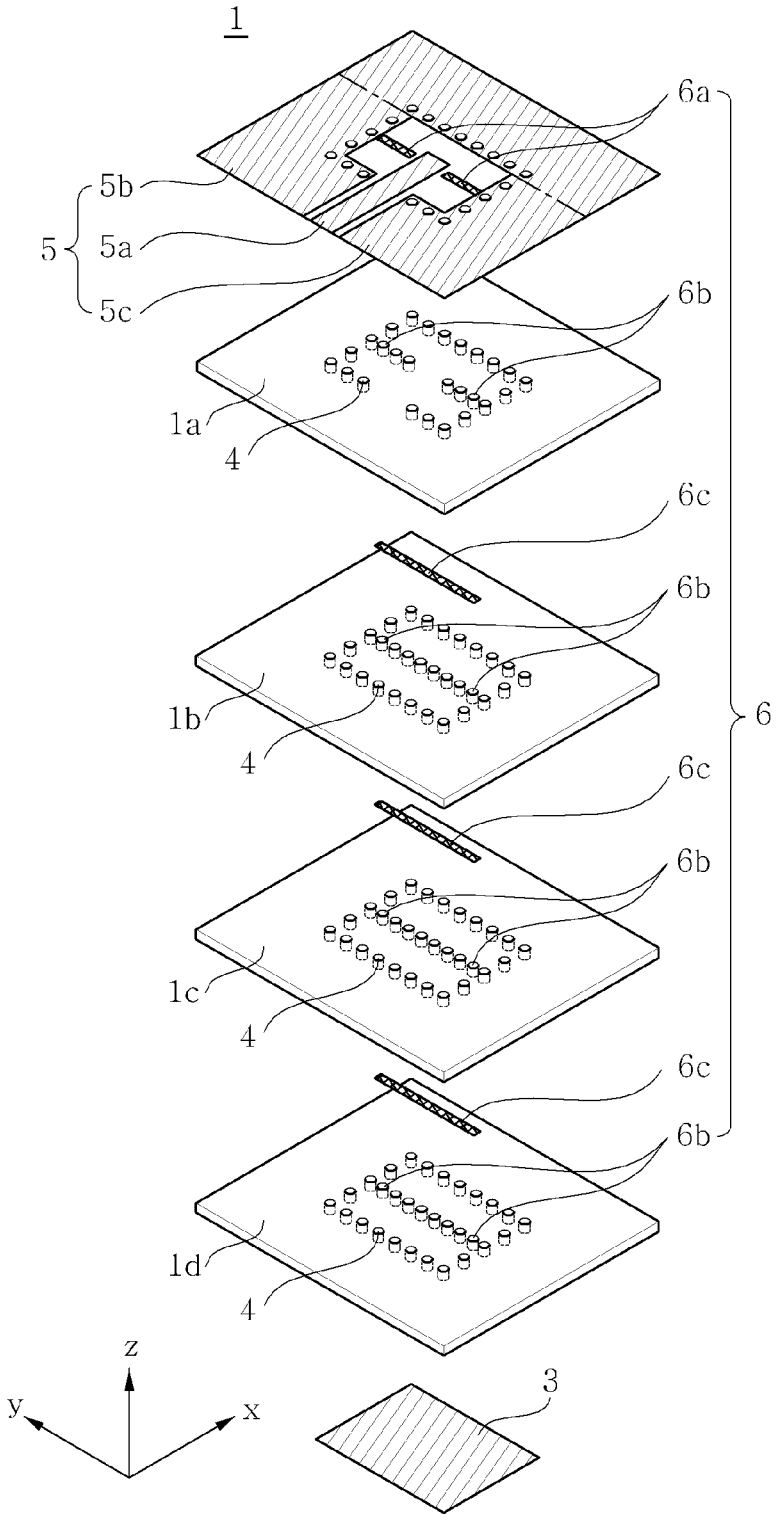
FIG. 33 is an exploded perspective view of a dielectric resonator antenna having a CPW line feeding part among various feeding parts of the dielectric resonator antenna embedded in a multilayer substrate for enhancing bandwidth according to an embodiment of the present invention.
Figure 34:
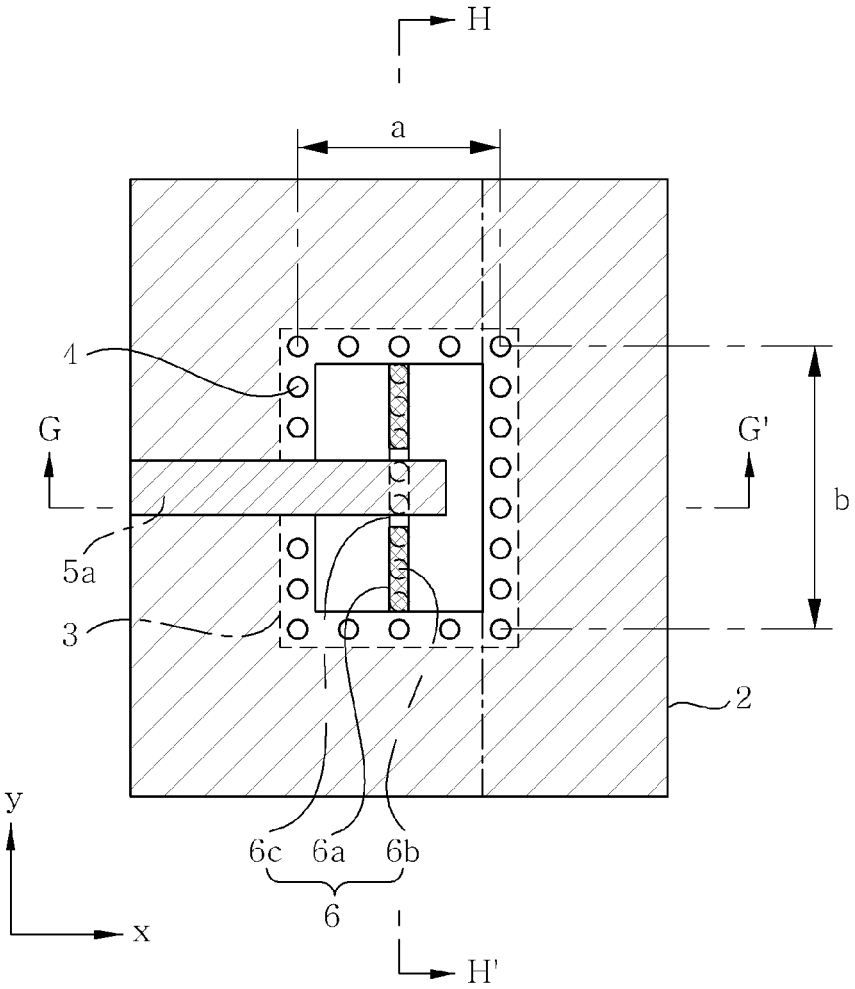
FIG. 34 is a top view of the dielectric resonator antenna of FIG. 33.
Figure 35:
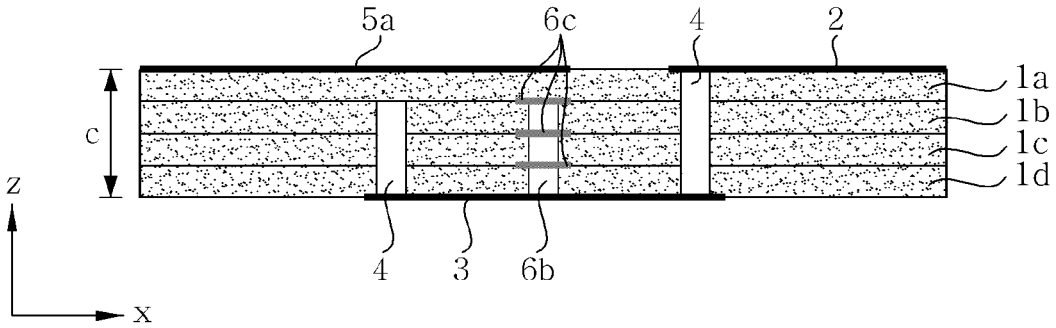
FIG. 35 is a sectional view of the dielectric resonator antenna of FIG. 33 taken along line G-G' of FIG. 34.
Figure 36:
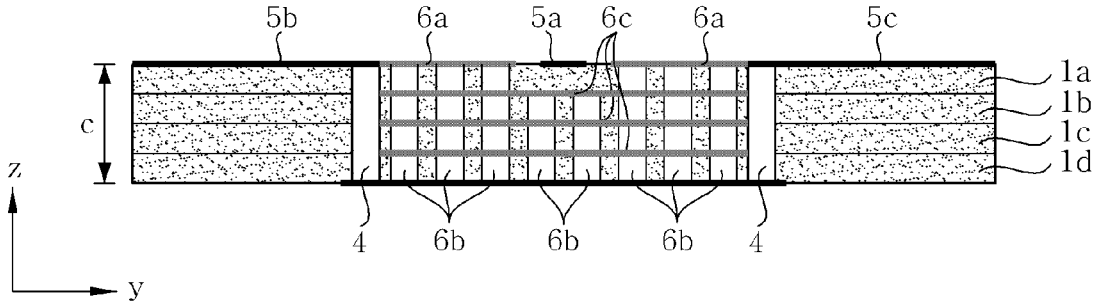
FIG. 36 is a sectional view of the dielectric resonator antenna of FIG. 33 taken along line H-H' of FIG. 34.

FIGS. 33 to 36 are diagrams showing an example in which the feeding part 5 of the dielectric resonator antenna embedded in the multilayer substrate 1 for enhancing bandwidth is implemented using a CPW line, among various structures of the feeding part 5 according to an embodiment of the present invention. FIG. 33 is an exploded perspective view of the dielectric resonator antenna having a CPW line feeding part 5, FIG. 34 is a top view of the dielectric resonator antenna of FIG. 33, FIG. 35 is a sectional view of the dielectric resonator antenna of FIG. 33 taken along line G-G' of FIG. 34, and FIG. 36 is a sectional view of the dielectric resonator antenna of FIG. 33 taken along line H-H' of FIG. 34.

The CPW line feeding part 5 of FIGS. 33 to 36 includes a feed line 5*a* which is formed as a linear conductive plate extending from one side surface of a dielectric resonator so that the feed line 5*a* is inserted into the dielectric resonator to be level with the opening of the dielectric resonator.

Further, the feeding part 5 includes a first ground plate 5*b* which is formed on the same surface as the feed line 5*a* and is spaced apart from one side surface of the feed line 5*a* by a predetermined distance d, and a second ground plate 5*c* which is formed on the same surface as the feed line 5*a* and is spaced apart from another side surface of the feed line 5*a* by the predetermined distance d.

Here, the first and second ground plates 5*b* and 5*c* may be formed to be integrated with the first conductive plate 2.

The feed line 5*a* of each of the microstrip line and CPW line feeding parts 5 may be formed on the top of the uppermost insulating layer 1*a* of the multilayer substrate 1.

In this case, in the CPW line feeding part 5, an end portion of the feed line 5*a* is to basically formed in a line shape, but may also be formed in a step shape 5*a*-1, a taper shape 5*a*-2 or a round shape 5*a*-3, as shown in FIG. 3.

Accordingly, the feed line 5*a* of the dielectric resonator antenna embedded in the multilayer substrate for enhancing bandwidth according to the present invention can be disposed at any location, except for at the bottom of the lowermost insulating layer 1*d* of the multilayer substrate 1, so that the freedom of design of the feed line 5*a* is high when the dielectric resonator antenna is manufactured, thus enabling the dielectric resonator antenna to be easily manufactured and to be widely utilized.

As described above, a dielectric resonator antenna embedded in a multilayer substrate for enhancing bandwidth according to the present invention can ensure about 10% or more bandwidth using only single and not double resonance.

Further, there are fewer variations in the antenna characteristics of the dielectric resonator antenna of the present invention, in relation to fabrication errors and an external environment, than there are for conventional patch antennas or stacked patch antennas, so that the manufacture of the antenna is facilitated and the utility of the antenna is expanded upon.

Furthermore, the dielectric resonator antenna is implemented using a structure of concentrating the radiation patterns of the antenna on a direction of an opening, thus not only realizing excellent antenna gain characteristics, but also obtaining excellent heat dissipation characteristics because the radiation of heat to the outside of the antenna is easily conducted through the opening.

Furthermore, when multiple resonances occur, a vertical conductive pattern part is inserted into a dielectric resonator, thus enhancing antenna characteristics by preventing the radiation patterns of the antenna from being deformed.

Although the preferred embodiments of the present invention have been disclosed for illustrative purposes, those skilled in the art will appreciate that various modifications, additions and substitutions are possible, without departing from the scope and spirit of the to invention as disclosed in the accompanying claims.

What is claimed is:

1. A dielectric resonator antenna embedded in a multilayer substrate, comprising:

multilayer substrate provided with a plurality of insulating layers stacked one on top of another;

a first conductive plate formed on a top of an uppermost insulating layer of the multilayer substrate and provided with an opening in the center;

a second conductive plate formed in the center of a bottom of a lowermost insulating layer of at least two insulating layers which are formed on a bottom of the first conductive plate, the second conductive plate being disposed at a location corresponding to that of the opening and the uppermost insulating layer being one of the at least two insulating layers that are formed on the bottom of the first conductive plate;

a plurality of first metal via holes configured to electrically connect layers between the uppermost insulating layer and the lowermost insulating layer, and vertically formed through the multilayer substrate so that the first metal via holes surround the opening of the first conductive plate at predetermined intervals and form vertical metal interfaces;

a feeding part configured to include a feed line for applying a high-frequency signal to a dielectric resonator which is embedded in the multilayer substrate in a shape of a cavity by the first conductive plate, the second conductive plate, and the metal interfaces formed by the first metal via holes; and a conductive pattern part inserted into the dielectric resonator so that a vertical metal interface intersecting the feed line is formed in the dielectric resonator, wherein the high-frequency signal resonated at a particular frequency is radiated through the opening of the first conductive plate when the high-frequency signal is passed through the feed line in a metal interface formed by the first conductive plate, the second conductive plate and a plurality of the first metal via holes, wherein the area of the second conductive plate is at least the cross sectional area of the metal interfaces formed by the first metal via holes, and wherein the conductive pattern part comprises:

a plurality of second metal via holes vertically formed through the multilayer substrate within the dielectric resonator: and One or more third conductive plates formed to be coupled to the plurality of second metal via holes between the insulatin layers through which the second metal via holes are formed, wherein the conductive pattern part forms the vertical interfaces insertecting the feed line in the dielectric resonator with a net-shaped conductive pattern by the second via holes and the one or more third conductive plates.

2. The dielectric resonator antenna as set forth in claim 1. wherein the dielectric resonator has a shape of a hexahedron.

3. The dielectric resonator antenna as set forth in claim 1, wherein the conductive pattern part has a shape of a horseshoe.

4. The dielectric resonator antenna as set forth in claim 3, wherein the second metal via holes are formed below at least one insulating layer, which is formed downwards on a bottom of the feed line, on a basis of the feed line.

5. The dielectric resonator antenna as set forth in claim 1, wherein the feed line is a stripline feeding part.

6. The dielectric resonator antenna as set forth in claim 5, wherein the stripline feeding part comprises:

a feed line formed as a linear conductive plate extending from one side surface of the dielectric resonator so that the feed line is inserted into the dielectric resonator;

a first ground plate disposed to correspond to the feed line and formed on a top of at least one insulating layer which is formed upwards on a top of the feed line; and a second ground plate disposed to correspond to the feed line and formed on a bottom of at least one insulating layer which is formed downwards on a bottom of the feed line.

7. The dielectric resonator antenna as set forth in claim 6, wherein the first ground plate is formed to be integrated with the first conductive plate.

8. The dielectric resonator antenna as set forth in claim 6, wherein the feed line is formed between a bottom of the uppermost insulating layer and a top of the lowermost insulating layer.

9. The dielectric resonator antenna as set forth in claim 6, wherein the feed line has an end portion formed in any one of line, step, taper and round shapes.

10. The dielectric resonator antenna as set forth in claim 1, wherein the feed line is a microstrip line feeding part.

11. The dielectric resonator antenna as set forth in claim 10, wherein the microstrip line feeding part comprises:

a feed line formed as a linear conductive plate extending from one side surface of the dielectric resonator so that the feed line is inserted into the dielectric resonator; and a ground plate disposed to correspond to the feed line and formed on a bottom of at least one insulating layer which is formed on a bottom of the feed line.

12. The dielectric resonator antenna as set forth in claim 11, wherein the feed line is formed on a top of the uppermost insulating layer.

13. The dielectric resonator antenna as set forth in claim 11, wherein the feed line has an end portion formed in any one of line, step, taper and round shapes.

14. The dielectric resonator antenna as set forth in claim 1, wherein the feeding part is a Coplanar Waveguide (CPW) line feeding part.

15. The dielectric resonator antenna as set forth in claim 14, wherein the CPW line feeding part comprises:

a feed line formed as a linear conductive plate extending from one side surface of the dielectric resonator so that the feed line is inserted into the dielectric resonator;

a first ground plate formed on a same surface as the feed line and spaced apart from one side surface of the feed line; and a second ground plate formed on a same surface as the feed line and spaced apart from another side surface of the feed line.

16. The dielectric resonator antenna as set forth in claim 15, wherein the first ground plate and the second ground plate are formed to be integrated with the first conductive plate.

17. The dielectric resonator antenna as set forth in claim 15, wherein the feed line is formed on a top of the uppermost insulating layer.

18. The dielectric resonator antenna as set forth in claim 15, wherein the feed line has an end portion formed in any one of line, step, taper and round shapes.

* * * * *